US007011035B2

(12) United States Patent
Sueshige et al.

(10) Patent No.: US 7,011,035 B2
(45) Date of Patent: Mar. 14, 2006

(54) UNDERWATER SCOOTER

(75) Inventors: Hiroshi Sueshige, Saitama (JP); Masayuki Osumi, Saitama (JP); Keiji Iino, Saitama (JP); Yoshihiro Iijima, Saitama (JP); Hiroaki Hasebe, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/102,163

(22) Filed: Apr. 8, 2005

(65) Prior Publication Data

US 2005/0223962 A1 Oct. 13, 2005

(30) Foreign Application Priority Data

| | | |
|---|---|---|
| Apr. 9, 2004 | (JP) | 2004-116150 |
| Apr. 9, 2004 | (JP) | 2004-116151 |
| Apr. 9, 2004 | (JP) | 2004-116152 |
| Apr. 9, 2004 | (JP) | 2004-116153 |
| Apr. 9, 2004 | (JP) | 2004-116154 |
| Apr. 9, 2004 | (JP) | 2004-116160 |

(51) Int. Cl.
*B63C 11/46* (2006.01)

(52) U.S. Cl. ..... 114/315

(58) Field of Classification Search ..... 114/315; 405/186; D12/308

See application file for complete search history.

(56) References Cited

U.S. PATENT DOCUMENTS

| | | | | |
|---|---|---|---|---|
| 3,650,234 | A * | 3/1972 | Goudy | 114/315 |
| 3,757,721 | A * | 9/1973 | Ohishi | 114/315 |
| 4,813,367 | A * | 3/1989 | Stevenson | 114/315 |
| 5,394,820 | A | 3/1995 | Dach | |

FOREIGN PATENT DOCUMENTS

| | | |
|---|---|---|
| JP | 01-101294 | 4/1989 |

* cited by examiner

*Primary Examiner*—Ed Swinehart
(74) *Attorney, Agent, or Firm*—Carrier Blackman & Associates, P.C.

(57) ABSTRACT

An underwater scooter includes a watertight vessel enclosing an engine disposed in the fore part of a cylindrically shaped main frame, a propeller disposed in the aft area, and a driveshaft passes through the interior of the main frame and transmits the output of the engine to the propeller. An operator rides upon air tanks disposed between the engine and the propeller on the main frame, so the burden on the operator can be reduced in comparison to that of conventional types that tow the operator. In addition, the propeller is disposed aft of the operator and also the exhaust gas from the engine is exhausted aft of the operator, so there is no risk of either the jet of water ejected by the propeller or the exhaust gas reducing the field of view or causing articles (goggles, etc.) worn by the operator to come off.

26 Claims, 34 Drawing Sheets

150d
14c1
150a
70
68
26a
150
150b
150f
150e
64
62
60
150c
12b
12a
26
86S
86Sa
12c
150c
62
150e
150f
150b
64
86
150d
150a
14c1
14c

UNDERWATER SCOOTER

BACKGROUND OF THE INVENTION

1. Field of the Invention

This invention relates to an underwater scooter that can travel on the surface of the water or underwater.

2. Description of the Related Art

Underwater scooters that can travel on the surface of the water or underwater under the control of an operator (diver) have been proposed in the past. This type of underwater scooter typically generates thrust by an internal combustion engine or electrical motor that drives a propeller as the drive power (power source). Moreover, it is provided with grips that are held onto by the operator, in a constitution such that it tows an operator holding onto the grips and assists their forward motion, as taught in Japanese Patent Publication No. Hei 4(1992)-17832, for example. Note that when an internal combustion engine is used as the drive power for the propeller, the air used for combustion is introduced from an air inlet disposed on the upper surface of the underwater scooter, as taught in U.S. Pat. No. 5,394,820, column 4, FIG. 3, etc, for example.

Underwater scooters according to the prior art are constituted such that they tow the operator (namely, the propeller is positioned forward of the operator), so that not only does the jet of water ejected by the propeller block the field of view of the operator, but there is also a risk of articles worn by the operator coming off.

In addition, the operator must continue to hold onto the grips during the entire time while being towed by the underwater scooter, so there are drawbacks in that the arms may readily become fatigued and this is a heavy burden. When adjusting the direction of movement or depth of travel, the operator must use the arms to adjust the direction of the underwater scooter, so the burden is particularly heavy at these times.

SUMMARY OF THE INVENTION

One object of the invention is therefore to overcome these problems of the prior art and provide an underwater scooter that prevents reduced field of view on the part of the operator and worn articles from coming off due to the jet of water ejected by the propeller, and also lightens the burden on the operator.

In addition, with an underwater scooter as described above, a motive power transmission system for transmitting the output of the drive power to the propeller is required. In addition, when an internal combustion engine is used as the drive power, the internal combustion engine requires an air intake system and exhaust system, and moreover, an internal pressure regulation system is required to regulate the internal pressure of the space enclosing the internal combustion engine which becomes hot. For this reason, large amounts of space are required to dispose the various systems, not only leading to a larger size for the underwater scooter, but also its constitution becomes complex, thereby leading to increased complexity of assembly work and maintenance work.

Accordingly, another object of the invention is to provide an underwater scooter wherein the motive power transmission system for transmitting the output of the drive power to the propeller, the air intake system and exhaust system of the internal combustion engine and the internal pressure regulation system for regulating the internal pressure of the space enclosing the internal combustion engine are disposed in a compact manner, and also its constitution is simplified, thus improving the ease of assembly and maintenance work.

In addition, the tow-behind type underwater scooter taught by the above-mentioned first reference No. 4-17832 has advantages in that it is compact and has superior maneuverability (small turning circle). On the other hand, with this type of underwater scooter, as described above, the operator must continue to hold onto the grips while being towed, so there are drawbacks in that the arms may readily become fatigued and this is a heavy burden.

On the other hand, a constitution wherein the operator rides upon the underwater scooter as taught by the above-mentioned second reference U.S. Pat. No. 5,394,820 can reduce the burden on the operator. However, if the underwater scooter is given a constitution wherein it can be ridden by the operator, a larger size is unavoidable and it is difficult to expect the superior maneuverability of a tow-behind type.

Accordingly, a further object of the invention is to provide an underwater scooter whereby it is possible to selectively obtain the two mutually exclusive advantages of reduced burden on the operator accompanying larger size and improved maneuverability accompanying smaller size.

In addition, with the art taught by the second reference ('820) mentioned above, the air to be supplied to the internal combustion engine is introduced from an air inlet disposed upon the upper surface of the underwater scooter, so there is a problem in that it can travel only upon the surface of the water where the air inlet does not become submerged.

Accordingly, a further object of the invention is to provide an underwater scooter that uses an internal combustion engine to drive a propeller and that can travel both upon the surface of the water and underwater.

In addition, the drive power of an underwater scooter is normally enclosed within a hermetically sealed space. For this reason, there are problems in that heat radiation is poor and overheating readily occurs.

In addition, a conventional tow-behind type underwater scooter has the propeller disposed forward of the operator, so there are problems in that the jet of water ejected by the propeller chills the body of the operator and also reduces comfort.

Accordingly, a further object of the invention is to provide an underwater scooter wherein the heat radiation is improved and overheating is prevented, and also the body of the operator is warmed to improve comfort.

In order to achieve the objects, there is provided an underwater scooter operable to enable user to travel thereon on a surface of water or underwater, comprising: a main frame disposed such that its lengthwise direction is parallel to a direction of forward motion of the scooter; a watertight vessel disposed on the main frame toward a fore end thereof in the direction of forward motion; a drive power unit enclosed within an interior of the watertight vessel; a propeller disposed on the main frame; a driveshaft passing through an interior of the main frame and transmitting an output of the drive power unit to the propeller so as to turn it; and a saddle area, disposed upon the main frame between the watertight vessel and propeller, on which the operator saddles.

BRIEF DESCRIPTION OF THE DRAWINGS

The above and other objects and advantages of the invention will be more apparent from the following description and drawings, wherein.

DETAILED DESCRIPTION OF THE PREFERRED EMBODIMENTS

Here follows a description of preferred embodiments of the underwater scooter according to the invention made with reference to the appended drawings.

Figure 1:
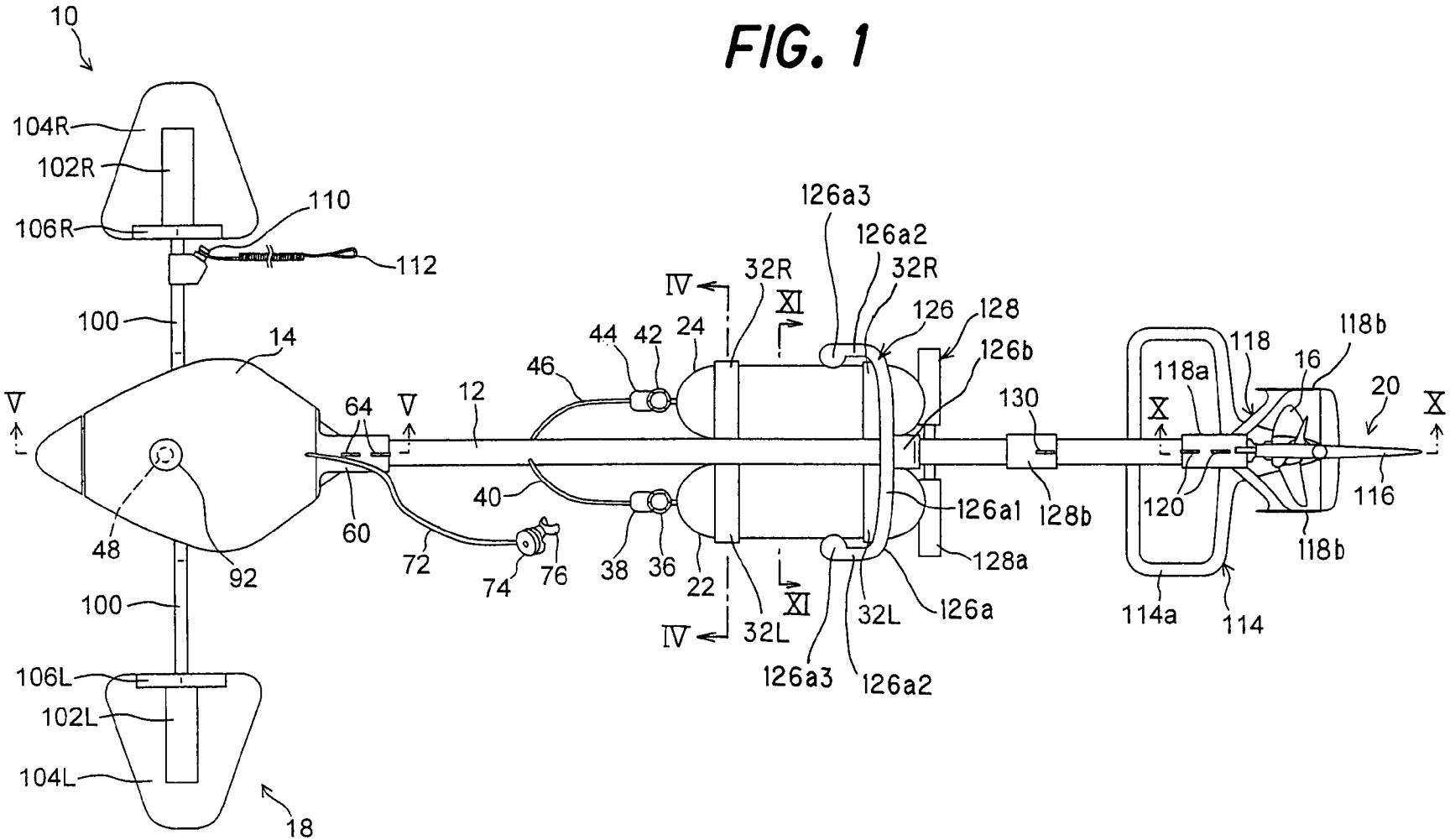
FIG. 1 is a top view of an underwater scooter according to a first embodiment of the invention.

FIG. 1 is a top view of an underwater scooter according to a first embodiment of the invention. In addition, FIG. 2 is a left side view of the underwater scooter shown in FIG. 1, while FIG. 3 is a front view of the underwater scooter shown in FIG. 1.

Figure 2:
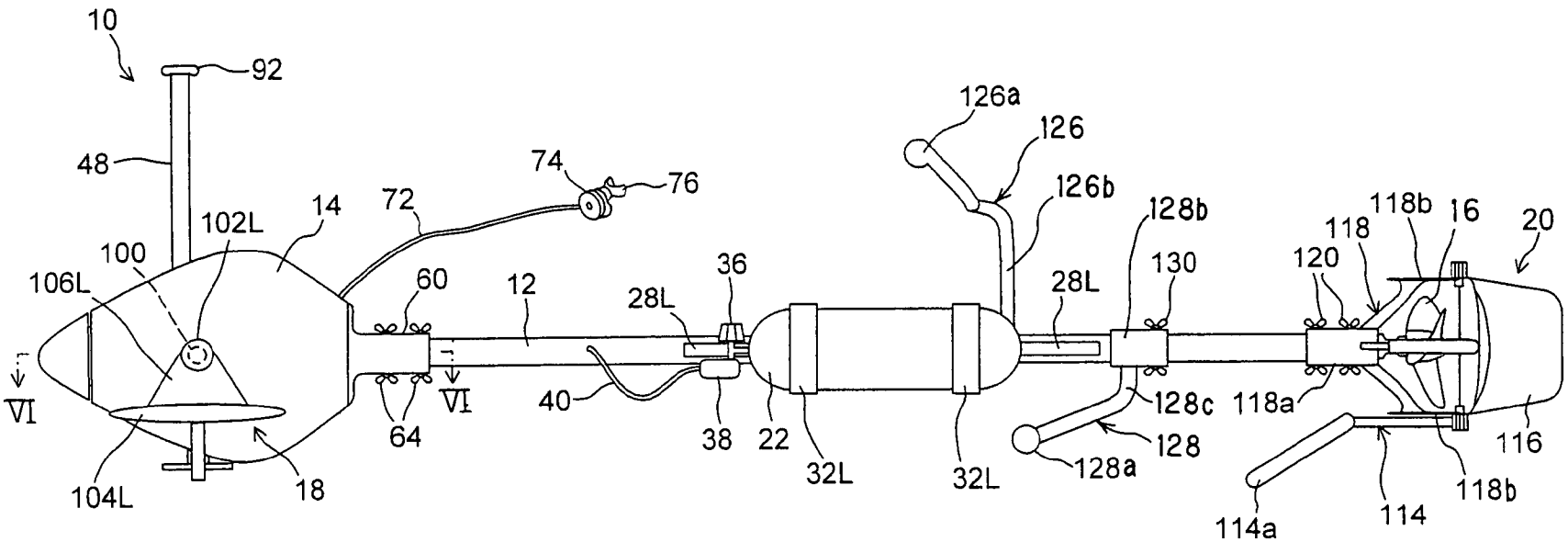
FIG. 2 is a left side view of the underwater scooter shown in FIG. 1.
Figure 3:
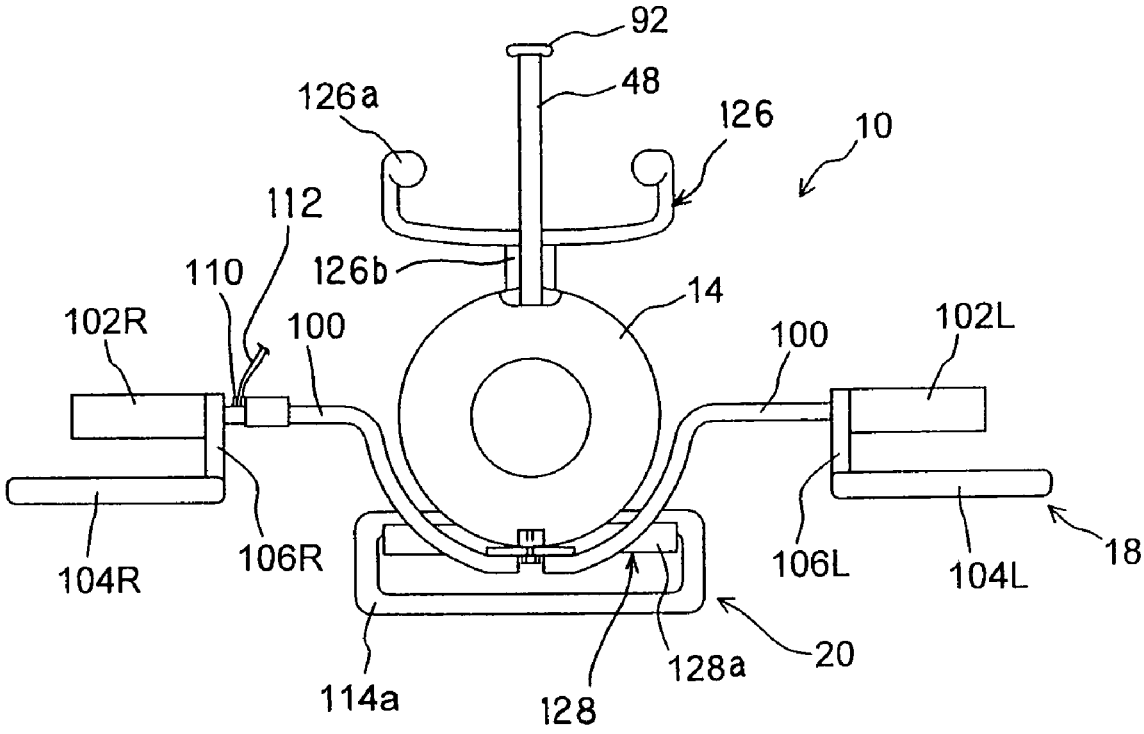
FIG. 3 is a front view of the underwater scooter shown in FIG. 1.

In FIG. 1 through FIG. 3, symbol 10 indicates an underwater scooter. To first describe the general constitution of underwater scooter 10, the underwater scooter 10 comprises: a cylindrical main frame 12 disposed such that its lengthwise direction is parallel to the direction of forward motion of the underwater scooter 10, an ovoid watertight (airtight) vessel 14 disposed upon the main frame 12 toward the fore end in the direction of forward motion, an internal combustion engine (drive power unit (power source); not shown in FIGS. 1–3; hereinafter called the "engine") E enclosed within the interior of the watertight vessel 14, a propeller 16 that is disposed upon the main frame 12 toward the aft end in the direction of forward motion and that is driven and turned by the engine to propel the underwater scooter 10, a driveshaft (not shown in FIGS. 1–3) that passes through the interior of the main frame 12 and that transmits the output of the engine to the propeller 16, a depth adjusting mechanism 18 that is disposed near the watertight vessel 14 and that adjusts the depth of travel of the underwater scooter 10, a steering mechanism 20 that is disposed near the propeller 16 and that adjusts the direction of forward motion of the underwater scooter 10, and a first air tank 22 and second air tank 24 that are disposed upon the main frame 12 between the watertight vessel 14 and propeller 16.

The constituent elements listed above will now be described in detail.

Figure 4:
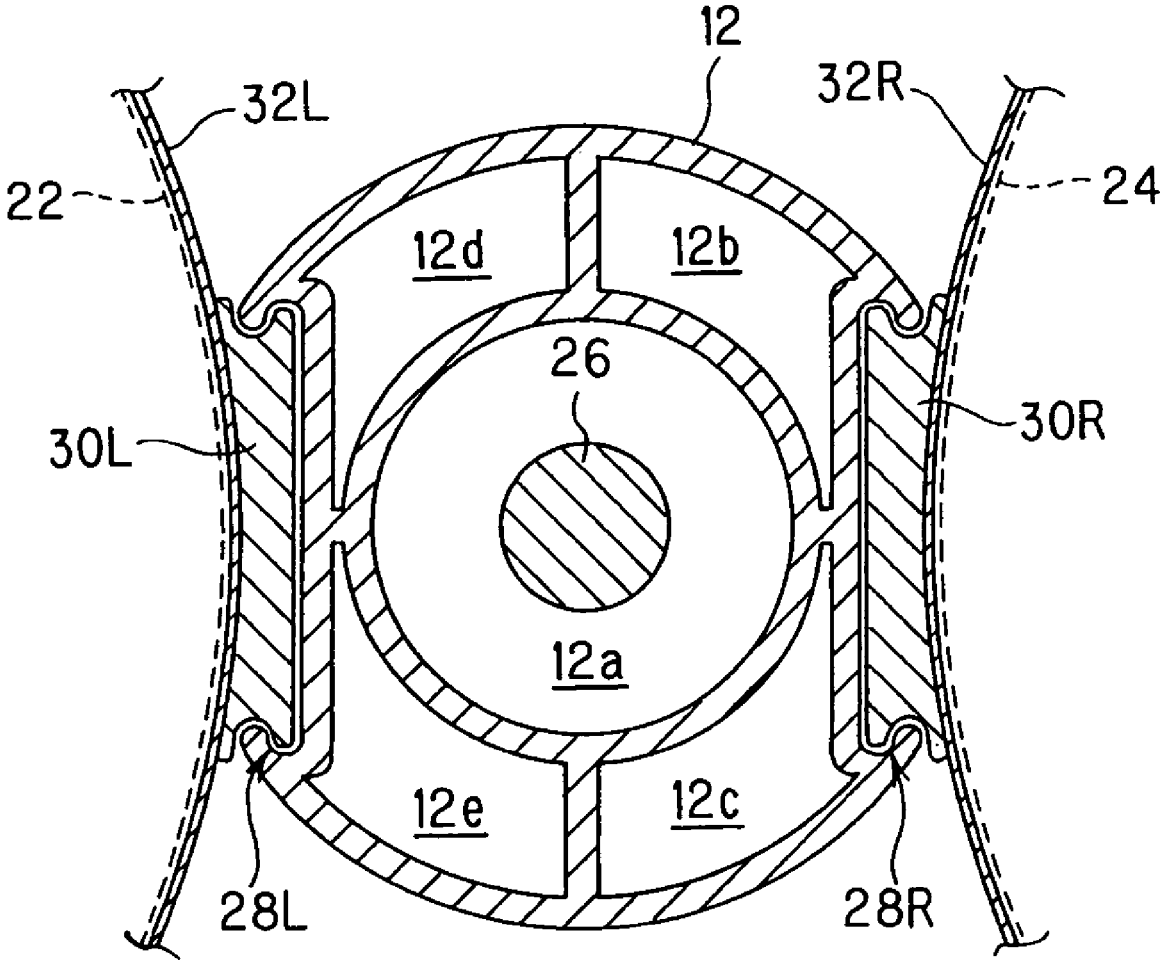
FIG. 4 is an enlarged cross section along the line IV—IV in FIG. 1.

FIG. 4 is an enlarged cross section along the line IV—IV in FIG. 1. As illustrated in the figure, the interior of the main frame 12 is divided by partition walls to form five passages. Each passage is formed as a single contiguous space from the fore end to the aft end of the main frame 12. Among the five passages, the cylindrical first passage 12*a* positioned in the center is the one through which the driveshaft (indicated by the symbol 26) described above passes. In contrast, the second through fifth passages 12*b*, 12*c*, 12*d* and 12*e* formed so as to divide the periphery of the first passage 12*a* serve as paths for the flow of air or exhaust gases as described later.

Grooves 28L and 28R that are substantially C-shaped in cross section (or have the reverse cross section in left-right symmetry) are formed on either side surface of main frame 12. As shown in FIG. 2, groove 28L (and groove 28R positioned on the aft surface) is formed such that it has a stipulated length in the lengthwise direction of main frame 12 (in the direction of forward motion).

Continuing on with the description of FIG. 4, sliders 30L and 30R that are substantially H-shaped in cross section are slidably fitted into the left and right grooves 28L and 28R, respectively. Specifically, the sliders 30L and 30R are constituted so as to be able to slide freely using the protrusions formed at the top edges and bottom edges of the grooves 28L and 28R as rails.

Belts 32L and 32R are provided upon the sliders 30L and 30R, respectively. The first air tank 22 and second air tank 24 described previously are mounted to the sliders 30L and 30R, respectively, by belts 32L and 32R, respectively.

Thereby, the first air tank 22 and second air tank 24 are mounted to the main frame 12 such that they are able to slide freely in the lengthwise direction (namely in the direction of forward motion of the underwater scooter 10).

Returning to the description of FIGS. 1–3, the first air tank 22 is connected via a valve 36 to a regulator 38. The regulator 38 is connected via a hose 40 to the interior of the main frame 12 (specifically the second passage 12*b*). On the other hand, the second air tank 24 is connected via a valve 42 to a regulator 44. The regulator 44 is connected via a hose 46 to the interior of the main frame 12 (specifically the third passage 12*c*). Note that the first and second air tanks 22 and 24 may have volumes of roughly 12 liters, for example, and may contain air compressed to high pressure (e.g. roughly 200 atm).

The air contained in the first air tank 22 is depressurized by the regulator 38 to a stipulated pressure (e.g., 10 atm) and then supplied via the hose 40 to the second passage 12*b* in the main frame 12. On the other hand, the air contained in the second air tank 24 is depressurized by the regulator 44 to a stipulated pressure (e.g., 10 atm) and then supplied via the hose 46 to the third passage 12*c* in the main frame 12.

Figure 5:
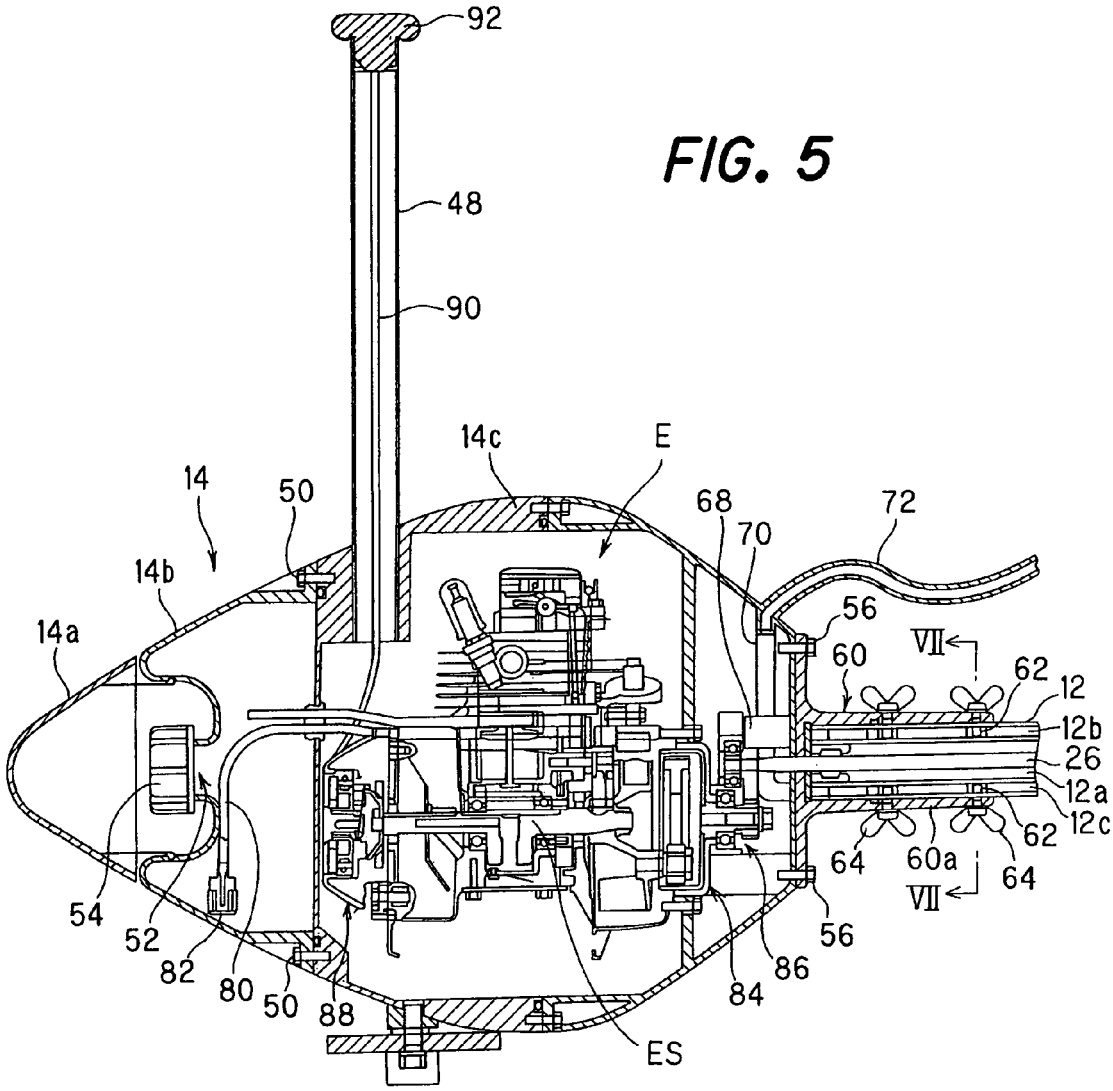
FIG. 5 is an enlarged cross section along the line V—V in FIG. 1.

FIG. 5 is an enlarged cross section along the line V—V in FIG. 1. In addition, FIG. 6 is an enlarged cross section along the line VI—VI in FIG. 2.

Figure 6:
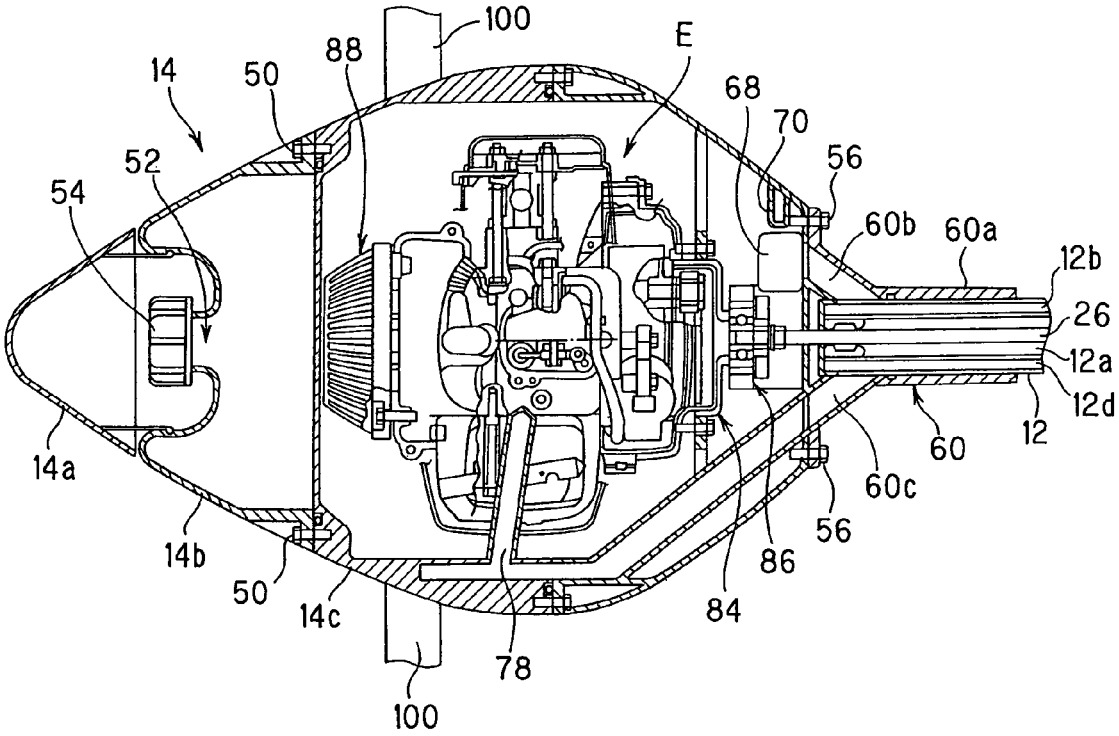
FIG. 6 is an enlarged cross section along the line VI—VI in FIG. 2.

As shown in FIG. 5 and FIG. 6, the watertight vessel 14 comprises three members: a bumper 14*a*, fuel tank 14*b* and an engine enclosure 14*c*, going from fore to aft in the direction of forward motion.

The engine E is enclosed within the engine enclosure 14*c*. The engine E may be a one-cylinder spark-ignition gasoline engine with a displacement of roughly 30 cc, for example. In addition, a snorkel 48 that protrudes upward is provided on top of the engine enclosure 14*c*, and the interior of the engine enclosure 14*c* communicates with the outside (atmosphere) via this snorkel 48.

The fuel tank 14*b* is mounted by bolts 50 to the front of the engine enclosure 14*c*, and the fuel tank 14*b* stores the gasoline fuel to be supplied to the engine E. In addition, a filler neck 52 is provided on a hole in the front surface of the fuel tank 14*b*, and a gas cap 54 seals the filler neck 52.

The bumper 14*a* is attached to the front of the fuel tank 14*b* in order to cover the gas cap 54. The bumper 14*a* is made from a material with a hardness less than that of the other members so as to deform and absorb the impact when the underwater scooter 10 may collide with another object. In addition, the bumper 14*a* is made to be removable without the use of tools in order to simplify filling the fuel tank 14*b* with gasoline fuel.

In addition, a connecting member 60 is mounted by bolts 56 to the aft of the engine enclosure 14*c*. The connecting member 60 is provided with a cylindrical portion 60*a* with an inside diameter roughly equal to the diameter of the main frame 12.

Figure 7:
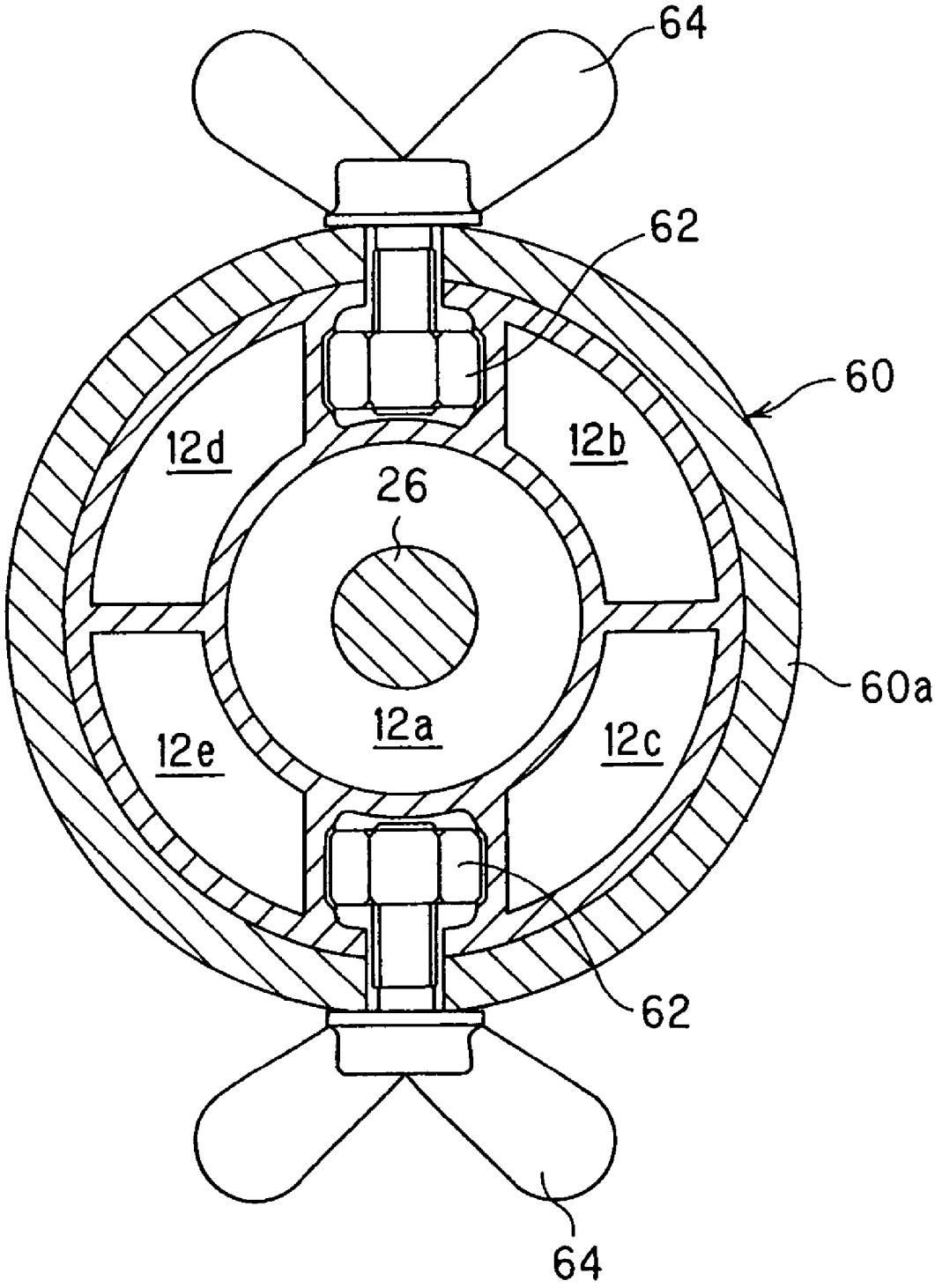
FIG. 7 is an enlarged cross section along the line VII—VII in FIG. 5.

FIG. 7 is an enlarged cross section along the line VII—VII in FIG. 5. As shown in FIG. 7, nuts 62 are enclosed near the tip of the main frame 12. As shown in FIGS. 5–7, the tip of the main frame 12 is inserted into the cylindrical portion 60*a* of the connecting member 60 and wing bolts 64 are screwed into the nuts 62 to mount the watertight vessel 14 to the fore part of the main frame 12 via the connecting member 60. Note that the nuts 62 are surrounded by the partition walls on all sides, and are thus kept from turning.

Returning to the description of FIGS. 5 and 6, the second passage 12*b* of the main frame 12 is connected via a communication passage 60*b* (shown in FIG. 6) formed in the connecting member 60 to a regulator 68 disposed within the watertight vessel 14. In addition, the third passage 12*c* is connected via a communication passage (not shown) formed in the interior of the connecting member 60 and a flow path 70 provided within the watertight vessel 14 to a hose 72 that continues on to the outside of the watertight vessel 14. The end of the hose is connected to a regulator 74 and a mouthpiece 76 is further connected to the regulator 74 (both of which are shown on FIGS. 1 and 2).

The fourth passage 12*d* of the main frame 12 is connected via a communication passage 60*c* formed in the connecting member 60 to an exhaust pipe 78 of the engine E. Note that while this is not shown, a fifth passage 12*e* communicates via a communication passage formed in the connecting member 60 to the interior of the watertight vessel 14.

The engine E is provided with an air intake line (not shown). An air filter is provided near the inlet of the air intake line, and a throttle body (both of which are not shown) is disposed downstream thereof. The throttle body encloses a throttle valve and a carburetor assembly (both of which are not shown) is provided on the upstream side thereof. A fuel pipe or line 80 (shown on FIG. 5) is connected to the carburetor assembly. The fuel pipe 80 communicates with the interior of the fuel tank 14*b* and also its end is connected to a fuel pump 82.

In addition, one end of the crankshaft ES (shown in FIG. 5) of the engine E is connected to a centrifugal clutch 84. The output side of the centrifugal clutch 84 is connected to a reduction gear mechanism 86 and the output side of the reduction gear mechanism 86 is connected to the fore end of the driveshaft 26. Note that the underwater scooter 10 is provided with a throttle unit (not shown) that adjusts the speed of the engine E, and the centrifugal clutch 84 transmits the motive power of the engine E when its speed is increased.

On the other hand, a recoil starter 88 is mounted to the other end of the crankshaft ES. A starter rope 90 for the recoil starter 88 passes through the interior of the snorkel 48 and also a starter grip 92 is provided at its end. The starter grip 92 is constituted such that it can be removably or detachably attached to the upper end of the snorkel 48. Specifically, the starter grip 92 is constituted such that it can be inserted into the upper end of the snorkel 48 so that it forms a watertight seal over its opening and also can be freely removed from the upper end. Specifically, when the engine E is to be started, the starter grip 92 is removed from the upper end of the snorkel 48 and the starter rope 90 is pulled. Once the engine E is started, the starter grip 92 is attached to the upper end of the snorkel 48 to seal its opening and prevent water from entering from the snorkel 48.

Figure 8:
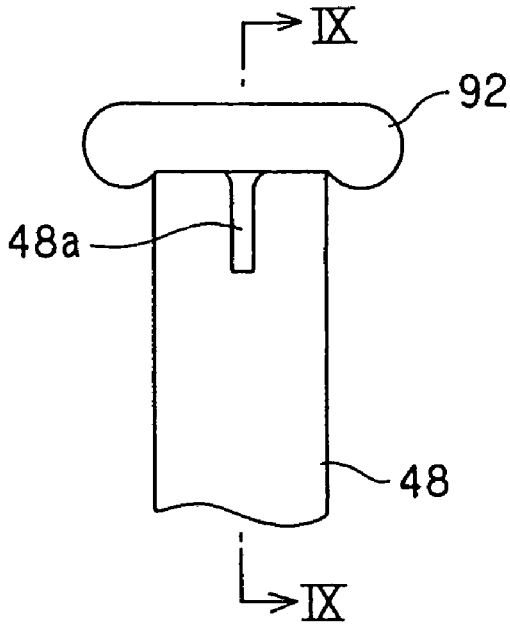
FIG. 8 is an enlargement of the area around the upper end of a snorkel shown in FIG. 2.
Figure 9:
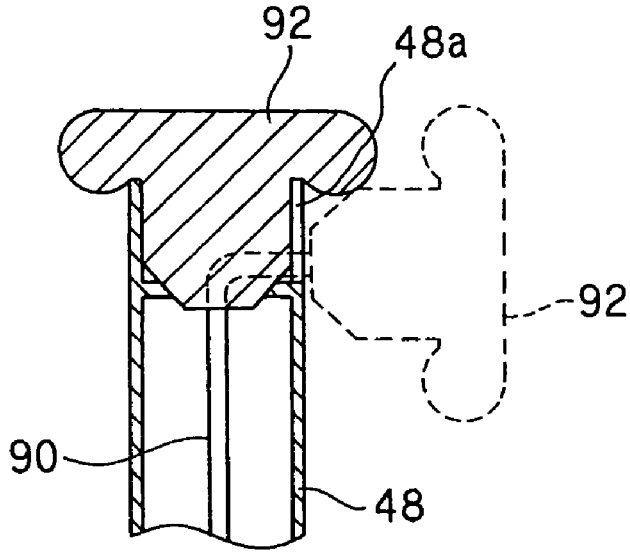
FIG. 9 is a cross section along the line IX—IX in FIG. 8.

FIG. 8 is an enlargement of the area around the upper end of the snorkel 48, while FIG. 9 is an enlarged cross section along the line IX—IX in FIG. 8. As shown in FIGS. 8 and 9, a notch 48*a* is provided at the upper end of the snorkel 48 so as to hold the starter grip 92 when removed (as indicated by the broken lines in FIG. 9).

Here, air from the first air tank 22 that is depressurized to a stipulated pressure and supplied to the second passage 12*b* of the main frame 12 is supplied via the communication passage 60*b* to the regulator 68, and also further depressurized by the regulator 68 to the inside pressure of the watertight vessel 14 and then supplied to the interior of the watertight vessel 14 (specifically the engine enclosure 14*c*).

The air supplied to the watertight vessel 14 passes through an air filter and is taken into the air intake line. The carburetor assembly injects gasoline fuel into the air thus taken in to create a fuel-air mixture. The fuel-air mixture thus created is taken into the combustion chamber (not shown) of engine E and is burned. The exhaust gas generated by the combustion of the fuel-air mixture flows via the exhaust pipe 78 and communication passage 60*c* into the fourth passage 12*d* of the main frame 12.

On the other hand, air from the second air tank 24 that is depressurized to a stipulated pressure and supplied to the third passage 12*c* of the main frame 12 is supplied via the communication passage above and flow path 70, and further supplied via hose 72 to a regulator 74. The regulator 74 is provided with a diaphragm and other components (not shown) so that, when an operator OP (diver) equipped with a mouthpiece 76 inhales, air depressurized to the pressure of the surrounding water is supplied to the operator.

In this manner, with the underwater scooter 10, the first air tank 22 is attached to the main frame 12 and air within the first air tank 22 is supplied as air for use in combustion by the engine E. In addition, the second air tank 24 is also attached to the main frame 12 and the air within the second air tank 24 is supplied as air for use in breathing by the operator.

Figure 10:
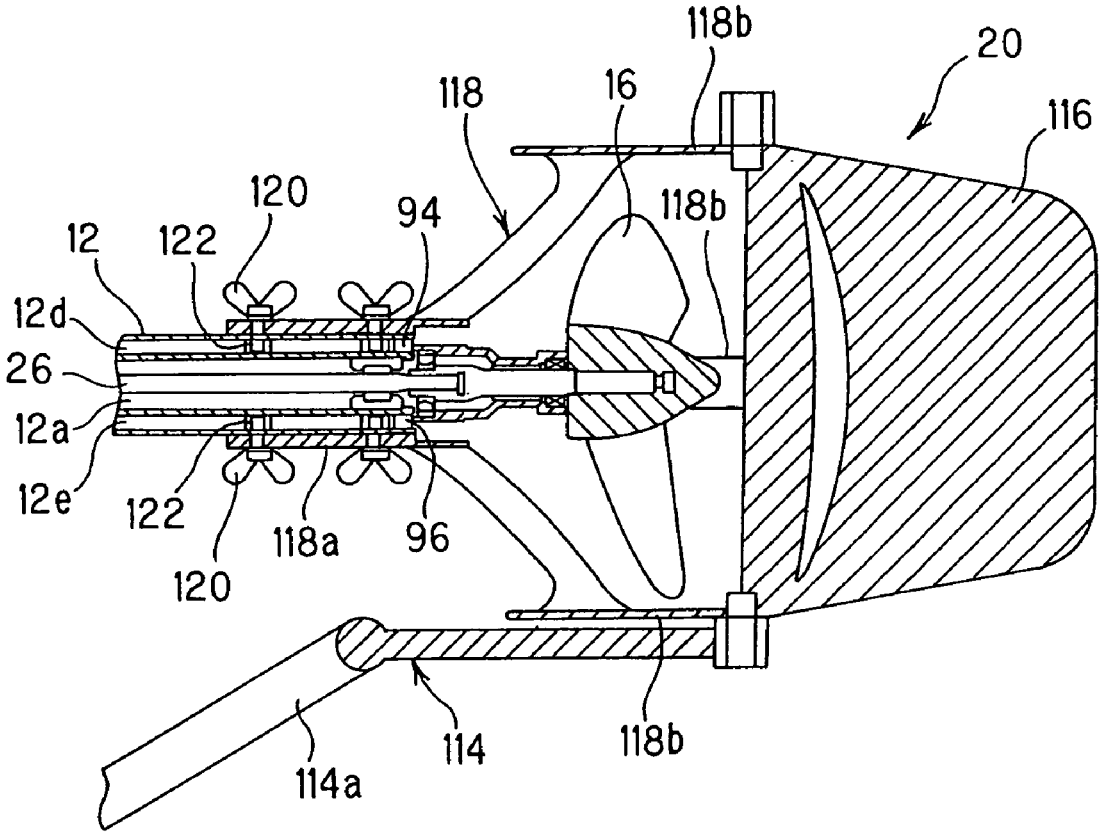
FIG. 10 is an enlarged cross section along the line X—X in FIG. 1.

FIG. 10 is an enlarged cross section along the line X—X in FIG. 1.

As shown in FIG. 10, the propeller 16 is attached to the aft end of the driveshaft 26 passing through the first passage 12*a*. Specifically, the output of the engine E disposed forward of the main frame 12 is transmitted via the aforementioned centrifugal clutch 84, reduction gear mechanism 86 and driveshaft 26 passing through the interior of the main frame 12 to the propeller 16 disposed aft of the main frame 12, and thus the propeller 16 is driven so that the underwater scooter 10 travels over the surface of the water or underwater.

In addition, a first one-way check valve 94 is disposed at the aft end of the fourth passage 12*d* of the main frame 12. The first one-way check valve 94 opens when exhaust gas flows into the fourth passage 12*d* so that its internal pressure exceeds a stipulated pressure, allowing the fourth passage 12*d* to communicate with the outside (underwater). Specifically, exhaust gas from the engine E is exhausted via the exhaust pipe 78, communication passage 60*c*, the fourth passage 12*d* of the main frame 12 and the first one-way check valve 94 to the aft (outside) of the underwater scooter 10.

Moreover, a second one-way check valve 96 is disposed at the aft end of the fifth passage 12*e* of the main frame 12. The second one-way check valve 96 opens when the internal pressure of the fifth passage 12*e* (in other words, the internal pressure of the watertight vessel 14 with which the fifth passage 12*e* communicates) exceeds a stipulated pressure, allowing the fifth passage 12*e* to communicate with the outside (underwater). Specifically, when the internal pressure of the watertight vessel 14 rises due to heat from the engine E or the like, the air within the watertight vessel 14 is exhausted via the communication passage formed in the connecting member 60, the fifth passage 12*e* of the main frame 12 and the second one-way check valve 96 to the aft (outside) of the underwater scooter 10, and thus the internal pressure of the watertight vessel 14 is regulated (depressurized).

As illustrated above, the first passage 12*a* formed in the main frame 12 serves as the passage through which passes the driveshaft 26 serving as the motive power transmission system. In addition, the second passage 12*b* serves as the flow path for air for combustion to be supplied to the engine E, namely becoming the air intake system for the engine E. The third passage 12*c* serves as the flow path for air for breathing to be supplied to the operator, namely becoming the system for supplying air for breathing. Moreover, the fourth passage 12*d* serves as the flow path for exhaust gas exhausted from the engine E, namely becoming the exhaust system for the engine E. The fifth passage 12*e* becomes a communication path for exhausting air within the watertight vessel 14 (the space enclosing the engine E) to the outside, namely becoming the internal pressure regulation system.

Note that while this is not shown, the second passage 12*b* and the third passage 12*c* are sealed at the aft end of the main frame 12. The second passage 12*b* and the third passage 12*c* are sealed at the aft end of the main frame 12 in order to fill the main frame 12 with air from the fore end to the aft end and give uniform buoyancy to the entire main frame 12. The one-way check valves of each of the fourth passage 12*d* and fifth passage 12*e* are disposed at the aft ends of each for the same reason.

Returning to the description of FIGS. 1–3, the depth adjusting mechanism 18 that adjusts the depth of travel of the underwater scooter 10 so that it either surfaces or dives is attached to the watertight vessel 14. The depth adjusting mechanism 18 comprises a handlebar 100, left and right cylindrical grips 102L and 102R, left and right elevators 104L and 104R comprising plates that are substantially trapezoidal in shape when viewed from above, and connector members 106L and 106R that connect the grips 102L and 102R to the elevators 104L and 104R.

To describe the depth adjusting mechanism 18 in detail, the handlebar 100 is attached to the watertight vessel 14, being disposed such that its lengthwise direction is parallel to a direction lateral to the underwater scooter 10. The left grip 102L is attached to the end of the handlebar 100 on the left side when viewed in the direction of forward motion. Similarly, the right grip 102R is attached to the end of the handlebar 100 on the right side when viewed in the direction of forward motion. Note that each of the left and right grips 102L and 102R is attached so that it is able to turn (specifically, rotate) freely around the handlebar 100 as the center of rotation.

The elevators 104L and 104R are connected to the left and right grips 102L and 102R, via the respective connector members 106L and 106R. Thereby, the elevators 104L and 104R are able to swivel freely around a lateral axis with respect to the underwater scooter 10. Specifically, by rotating the grips 102L and 102R, it is possible to vary the magnitude of inclination and orientation of the elevators 104L and 104R around a lateral axis with respect to the underwater scooter 10, and thus adjust the buoyancy (forces that causes the underwater scooter 10 to dive or surface) acting on the elevators 104L and 104R.

In addition, an emergency switch 110 is provided at an appropriate position on the handlebar 100. One end of an emergency cord 112 (shown in FIG. 1 and FIG. 3) that serves as an on/off trigger is attached to the emergency switch 110. The other end of the emergency cord 112 is attached to the wrist of the operator as described later.

On the other hand, the steering mechanism 20 is attached to the aft end of the main frame 12. The steering mechanism 20 comprises a foot stand 114, a rudder 116 connected to the foot stand 114 and a connecting member 118 that connects them to the main frame 12.

To describe the steering mechanism 20 in detail, the connecting member 118 is provided with a cylindrical portion 118*a* with an inside diameter roughly equal to the diameter of the main frame 12. As shown in FIG. 10, the aft end of the main frame 12 is inserted into the cylindrical portion 118*a* of the connecting member 118 and wing bolts 120 are screwed into nuts 122 enclosed in the interior of the main frame 12 to mount the connecting member 118, or in other words, the steering mechanism 20 to the main frame 12. Note that while this is not shown, the nuts 122 like the aforementioned nuts 62 are surrounded by the partition walls on all sides, and are thus kept from turning.

The connecting member 118 is provided with a total of four vanes 118*b* (top, bottom, left and right) connected to the aforementioned cylindrical portion 118*a*. The vanes 118*b* are formed so as to avoid contact with the propeller 16 in either the vertical direction or the lateral direction and also their aft ends are positioned further aft of the propeller 16. The aforementioned foot stand 114 and the rudder 116 connected to it are supported such that they are able to swivel freely around a vertical axis at the aft ends of the two of the vanes 118*b* disposed at the top and bottom. Specifically, by manipulating the foot stand 114 (rotating it around a vertical axis), the rudder 116 can be made to swivel around a vertical axis, thus adjusting the direction of forward motion of the underwater scooter 10.

In addition, as shown in FIGS. 1–3, a waist holder 126 is attached near the aft ends of the first and second air tanks 22 and 24.

Figure 11:
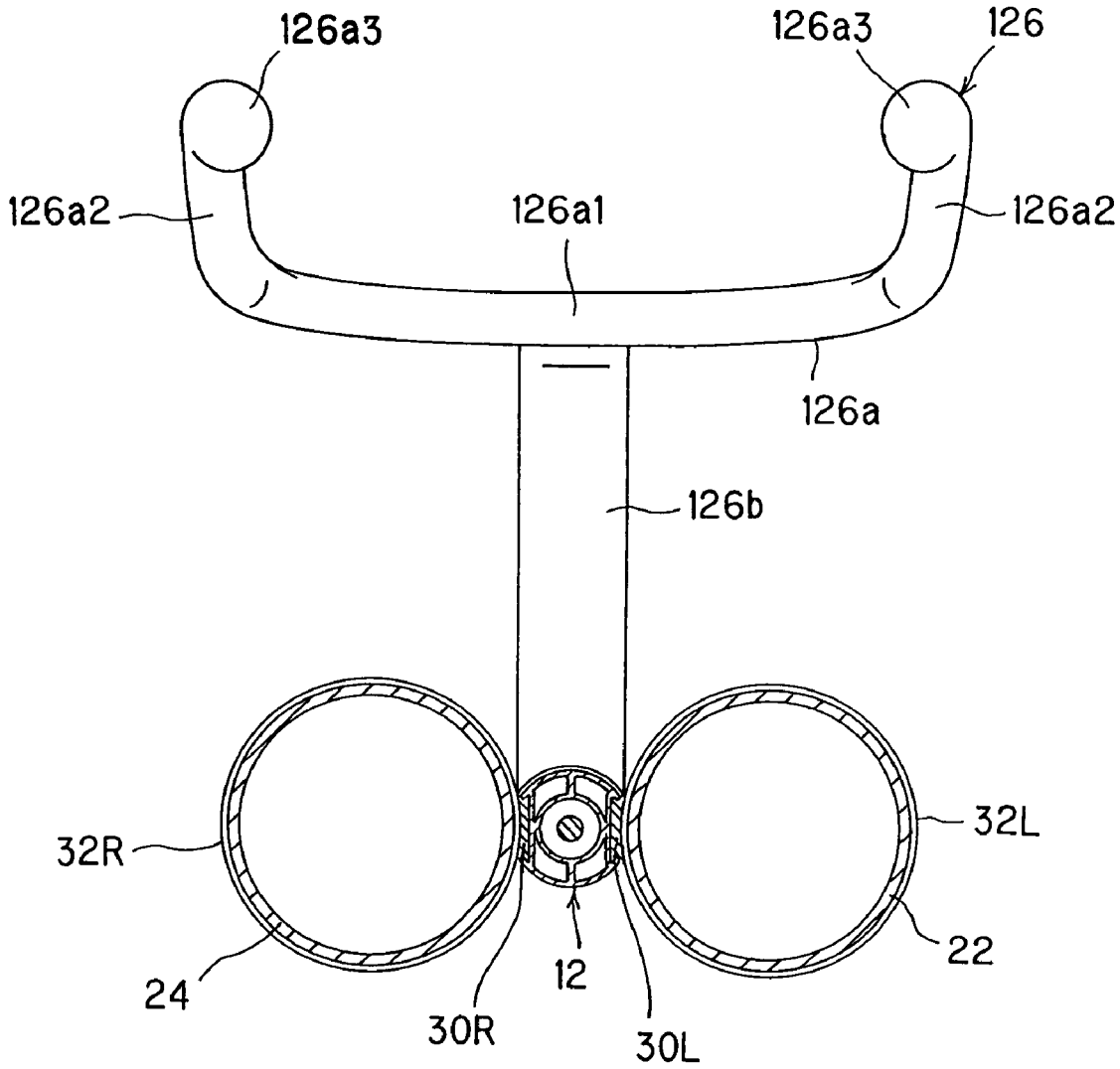
FIG. 11 is an enlarged cross section along the line XI—XI in FIG. 1.

FIG. 11 is an enlarged cross section along the line XI—XI in FIG. 1. As shown in FIG. 11, the waist holder 126 is specifically attached to the left and right sliders 30L and 30R. Thereby, the waist holder 126 can slide freely in the direction of forward motion of the underwater scooter 10 together with the first and second air tanks 22 and 24.

To describe in detail the shape of the waist holder 126 in reference to FIGS. 1–3 and FIG. 11, as shown in the figure, the waist holder 126 comprises a support 126*a* that supports the waist of the operator and a connector 126*b* that connects the support 126*a* to the left and right sliders 30L and 30R.

The support 126*a* is formed by bending or curving a cylindrical member. Specifically, the support 126*a* is provided with a first portion (indicated by the symbol 126*a*1 in FIG. 1 and FIG. 1) that is bent so that the fore portion is convex in the direction of forward motion, second portions (indicated by the symbol 126*a*2 in FIG. 1 and FIG. 1) formed by bending the left and right sides of the waist holder so that they protrude upward at a stipulated angle from the aft part in the direction of forward motion, when the lengthwise direction of the aforementioned first portion 126*a*1 is disposed so as to be parallel to a direction lateral to the underwater scooter 10 as shown in the figure. In addition, in the support 126*a*, the tips of the second portions (indicated by the symbol 126*a*3 in FIG. 1 and FIG. 11) are formed so as to be spherical or substantially spherical.

The connector 126*b* is formed in the shape of a column (with its lengthwise direction parallel to the vertical direction), with its upper end connected to the center of the support 126*a* (center in the lengthwise direction) and its lower end attached near the aft ends of the left and right sliders 30L and 30R. Thereby, the support 126*a* is disposed above the aft ends of the first and second air tanks 22 and 24.

Continuing the description of FIGS. 1–3, a leg rest 128 is further attached to the main frame 12.

Figure 12:
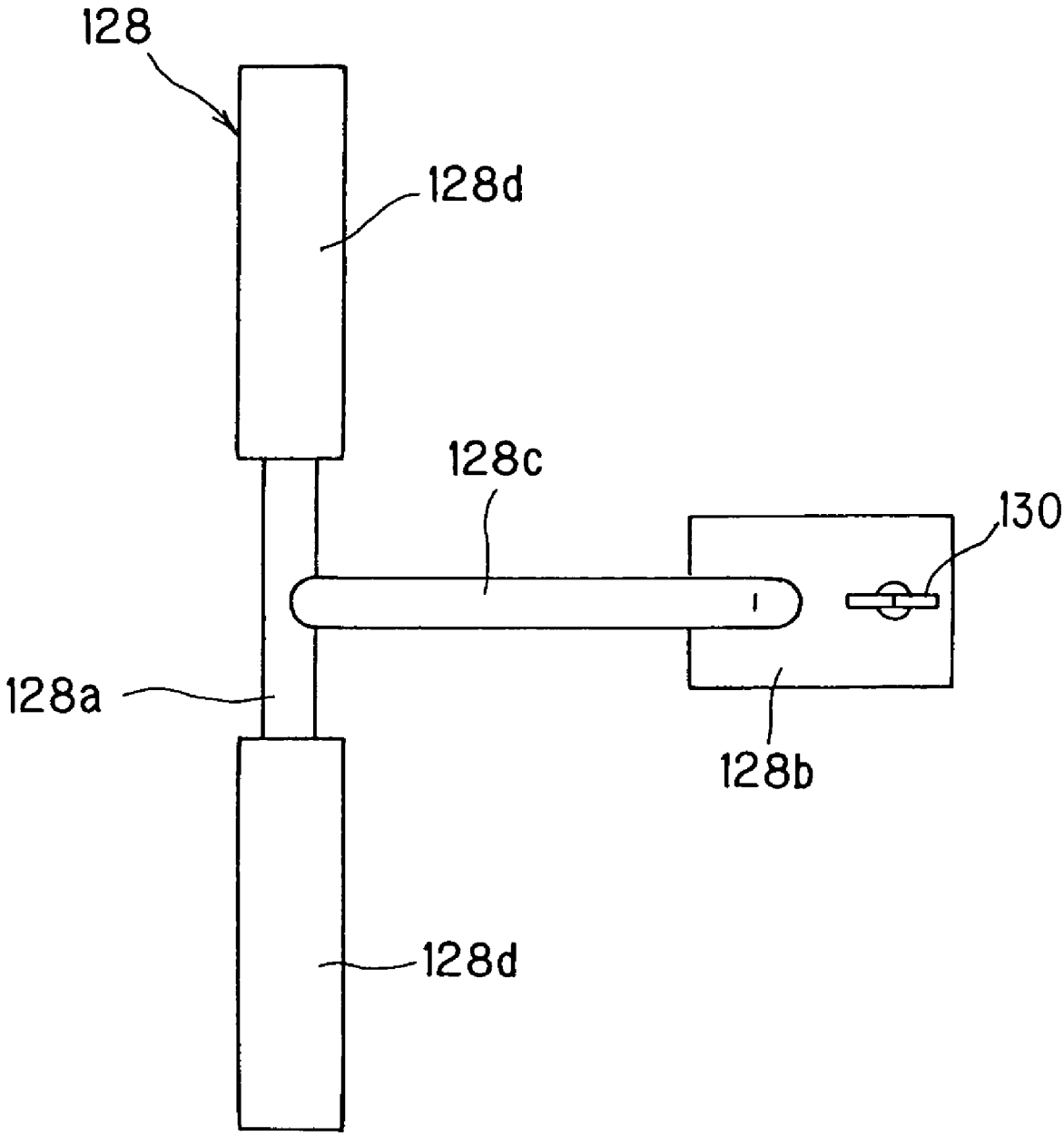
FIG. 12 is a bottom view of a leg rest of FIG. 1.

FIG. 12 is a bottom view of the leg rest 128. To describe in detail the leg rest 128 in reference to FIGS. 1–3 and FIG. 12, as shown in the figure, the leg rest 128 comprises a support 128*a* that supports the legs of the operator, a cylindrical part 128*b* attached to the main frame 12 and a connector 128*c* that connects the support 128*a* to the cylindrical part 128*b*. The cylindrical part 128*b* is formed so that its inside diameter is roughly equal to the diameter of the main frame 12.

As illustrated in the figures, the cylindrical part 128*b* is attached aft of the aforementioned left and right grooves 28L and 28R in the main frame 12. The cylindrical part 128*b* is attached to the main frame 12 by inserting the main frame 12 into the cylindrical part 128*b* and screwing wing bolts 130 into nuts enclosed in the interior of the main frame 12. Note that while this is not shown, the nuts into which the wing bolts 130 are screwed, like the aforementioned nuts 62, are surrounded by the partition walls on all sides, and are thus kept from turning.

As shown in the figure, the connector 128*c* comprises a cylindrical member formed such that when one end is connected to the bottom of the cylindrical part 128*b*, the other end is positioned below the aforementioned left and right grooves 28L and 28R, or in other words, below the first and second air tanks 22 and 24 and waist holder 126.

The support 128*a* is disposed such that its lengthwise direction is parallel to a direction lateral to the underwater scooter 10, and also the other end of the aforementioned connector 128*c* is connected to its center (center in the lengthwise direction). Specifically, the support 128*a* is disposed such that its lengthwise direction is parallel to a direction lateral to the underwater scooter 10 below the first and second air tanks 22 and 24 and waist holder 126. Note that the support 128*a* is covered with rubber or other shock-absorbing material (indicated by the symbol 128*d* in FIG. 12) except near its center.

Figure 13:
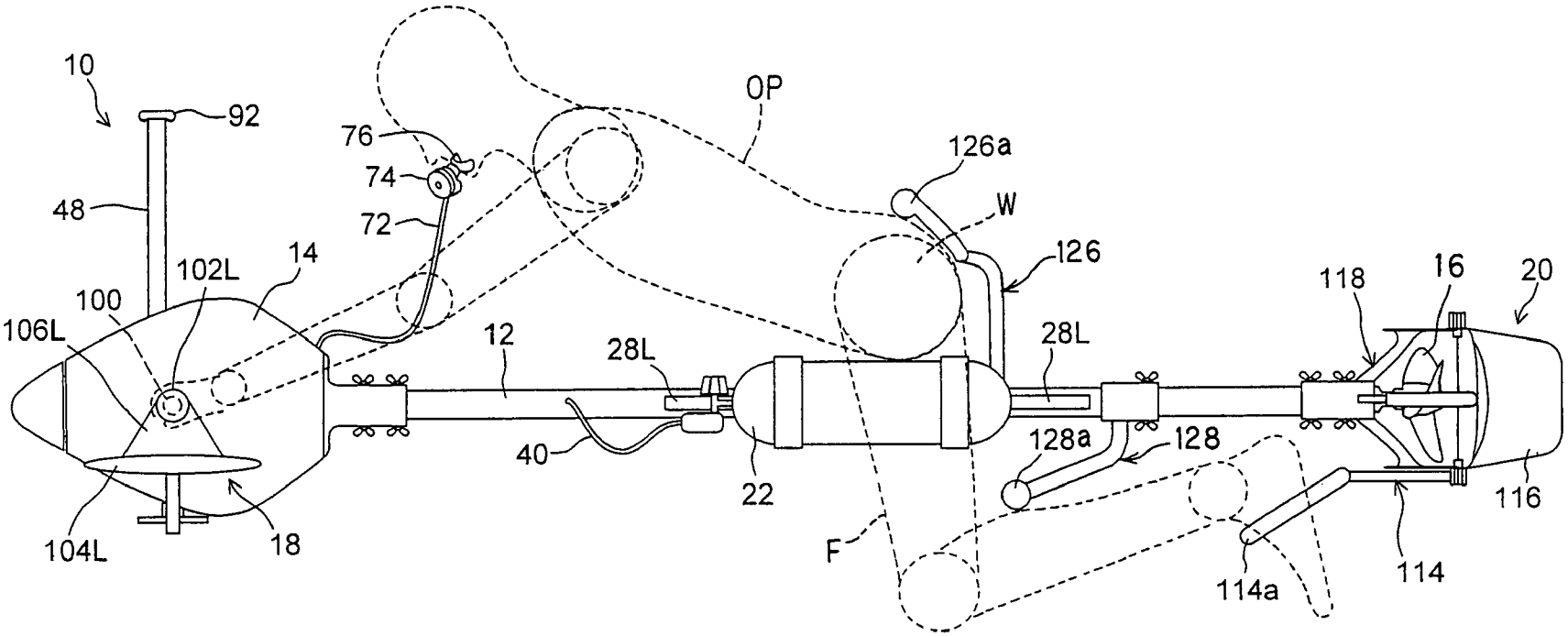
FIG. 13 is a left-side view of the underwater scooter with an operator riding thereon, shown in FIG. 1.

FIG. 13 is a left-side view of the underwater scooter 10 and the operator riding it.

As shown in FIG. 13, the operator OP rides above the first air tank 22 and the second air tank 24. Specifically, the operator OP is seated upon the first air tank 22 and the second air tank 24 so as to straddle the main frame 12. Taking a forward-inclined posture, the operator holds onto the forward-positioned left and right grips 102L and 102R and also places their feet upon the aft-positioned footrest 114*a* of the foot stand 114, or specifically, rests the backs of their feet there. Note that the footrest 114*a* is annular in shape in a top view, as shown on FIG. 1.

At this time, the waist W of the operator OP is supported by the support 126*a* of the waist holder 126. Specifically, the rear part and sides of the waist W are surrounded by the support 126*a* (even more specifically, the first portion 126*a*1 of the aforementioned support 126*a* touches the rear part of the waist W and also the second portions 126*a*2 touch the sides of the waist W). In addition, the legs F of the operator OP, or specifically the areas near the back of the knee, touch and are supported by the support 128*a* of the leg rest 128.

In addition, one end of the aforementioned emergency cord 112 (omitted from FIG. 13) is worn on the wrist of the operator OP. Thereby, should the operator OP fall off of the underwater scooter 10, the other end of the emergency cord 112 will be pulled out of the emergency switch 110, and an emergency shutdown signal is sent to shut down the engine E.

Here follows a description of how the operator OP operates the underwater scooter 10, or specifically how the depth of travel and direction of motion are adjusted.

Figure 14:
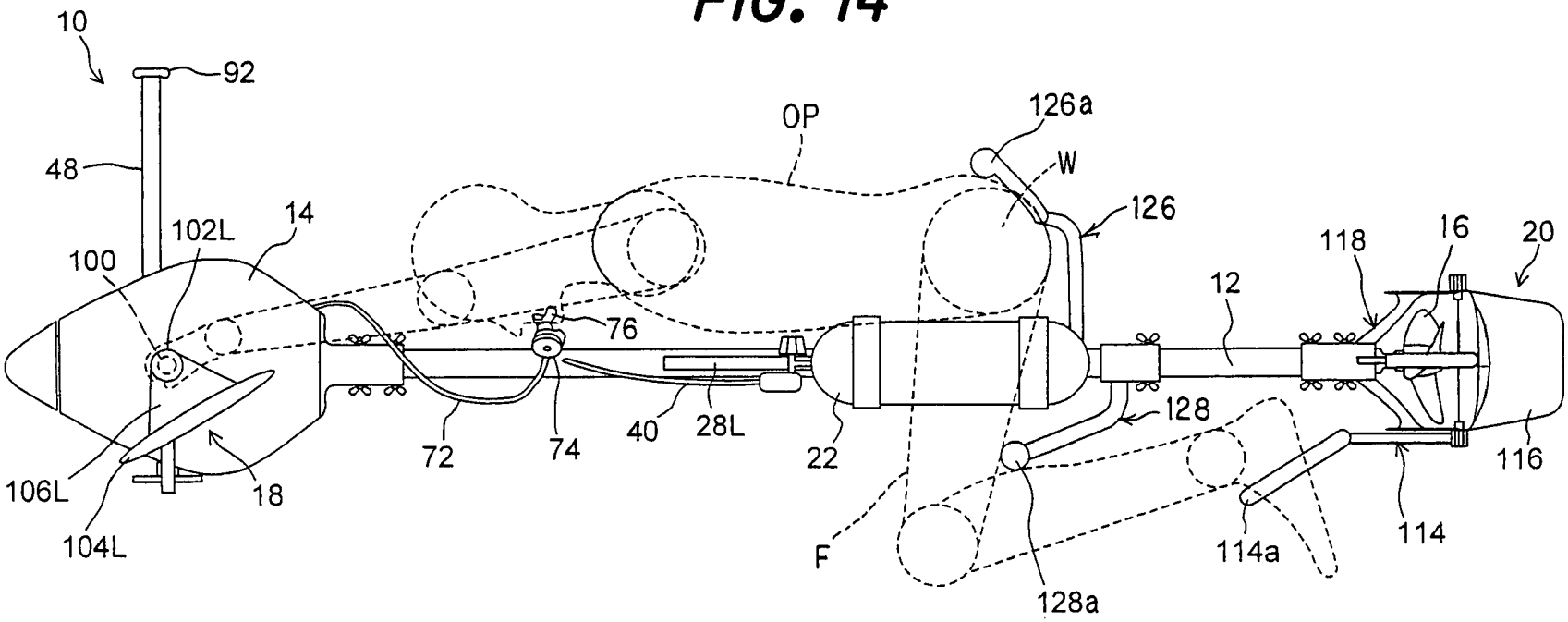
FIG. 14 is also a left-side view of the underwater scooter with the operator riding thereon, shown in FIG. 1.

First, to make the underwater scooter 10 dive, as shown in FIG. 14, the left and right grips 102L and 102R are rotated so that the left and right elevators 104L and 104R are positioned with their fore edges below their aft edges. When the underwater scooter 10 moves forward in this state, a downward force acts on the left and right elevators 104L and 104R, causing the underwater scooter 10 to dive. In addition, at this time, the operator OP slides the first and second air tanks 22 and 24 serving as the saddle area toward the aft.

Figure 15:
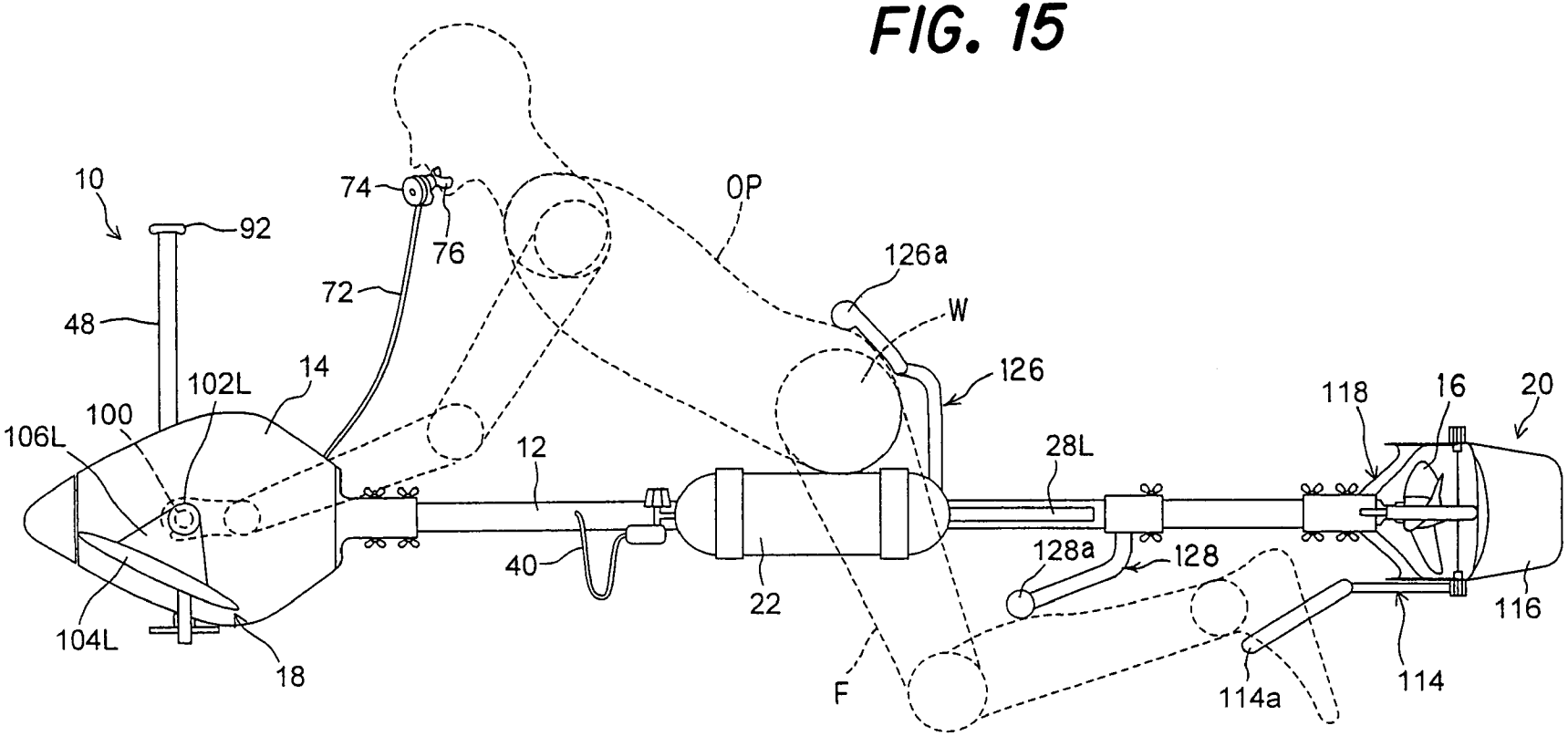
FIG. 15 is also a left-side view of the underwater scooter with the operator riding thereon, shown in FIG. 1.

Namely, the position at which the buoyancy of the first and second air tanks 22 and 24 acts is shifted toward the aft. Thereby, the buoyancy of the aft part of the underwater scooter 10 becomes greater and the fore part of the underwater scooter 10 sinks down (the aft part floats up), thus assuming a posture suited to diving (making diving easier). Similarly, to make the underwater scooter rise, as shown in FIG. 15, the left and fight grips 102L, 102R are positioned with their fore edges above their aft edges.

Note that when the underwater scooter 10 is traveling upon the surface of the water or near the surface (namely when the depth of travel is shallow and the upper end of the snorkel 48 is positioned above the surface of the water), the starter grip 92 is removed from the upper end of the snorkel 48 and held in the notch 48*a* described above (namely so that it does not seal the opening) so that outside air can be taken in as the air used for combustion in the engine E. At this time, the valve 36 connected to the first air tank 22 can be closed so that the supply of air from the first air tank 22 is halted, thus reducing the consumption of air contained in the tank.

In this manner, with the underwater scooter 10 according to the first embodiment of the present invention, the watertight vessel 14 enclosing the engine E is disposed in the fore part of the cylindrically shaped main frame 12, while the propeller 16 is disposed in the aft area, and the driveshaft 26 that passes through the interior of the main frame 12 transmits the output of the engine E to the propeller 16, and also, the operator OP rides upon the first and second air tanks 22 and 24 disposed between the engine E and the propeller 16 on the main frame 12, so the burden on the operator can be reduced in comparison to that of conventional types that tow the operator.

In addition, the propeller 16 is disposed aft of the operator OP and also the exhaust gas from the engine E passes through the fourth passage 12*d* in the main frame 12 and is exhausted aft of the operator OP, so there is no risk of either the jet of water ejected by the propeller 16 or the exhaust gas from the engine E reducing the field of view of the operator OP. Moreover, there is no risk of either the jet of water ejected by the propeller 16 or the exhaust gas from the engine E causing articles (goggles, etc.) worn by the operator OP to come off.

In addition, a snorkel 48 that allows the interior of the watertight vessel 14 enclosing the engine E to communicate with the atmosphere is provided along with the first air tank 22 that contains air to be supplied to the interior of the watertight vessel 14, so when the underwater scooter 10 is traveling upon the surface of the water, air to be used for combustion can be supplied to the engine E by at least one of the snorkel 48 or the first air tank 22, and also, when the underwater scooter 10 is traveling underwater, air to be used for combustion can be supplied from the first air tank 22, and thus the engine E can drive the propeller 16 so that it is possible to travel both upon the surface of the water and underwater.

In addition, by providing a recoil starter 88 that starts the engine E and using the starter grip 92 of the recoil starter to seal the opening of the snorkel 48, the engine E enclosed within the watertight vessel 14 can be easily started and also, it is possible to prevent water from intruding into the interior of the watertight vessel 14 from the snorkel 48 while the underwater scooter 10 is submerged.

In addition, the second air tank 24 containing air to be supplied to the operator OP is provided, so it is possible to supply air to the engine E for combustion at the same time that air for breathing is supplied to the operator OP, and thus the comfort of the operator can be improved.

In addition, the waist holder 126 which holds or supports the waist W of the operator OP is attached to the first and second air tanks 22 and 24, so the posture of the operator can be stabilized, and the burden on the operator can be reduced even further.

In addition, the first and second air tanks 22 and 24 serving as the saddle area are attached to the main frame 12 such that they can slide freely in the direction of forward motion, so their position can be adjusted optimally depending on the build and posture of the operator, and thus the burden on the operator can be reduced even more effectively. Furthermore, the waist holder 126 also slides together with the air tanks 22 and 24, so by adjusting the position of the first and second air tanks 22 and 24 optimally depending on the build and posture of the operator, the hold or support of the waist W by the waist holder 126 is more solid and the posture can be made more stable, and thus the burden on the operator can be reduced even further.

In addition, the leg rest 128 that supports the legs F of the operator OP is attached to the main frame 12, so the posture of the operator can be made even more stable, and thus the burden on the operator can be reduced even further.

In addition, the third portions 126*a*3 of the support 126*a* of the waist holder 126 (the tips of the second portion 126*a*2 protruding aft in the direction of forward motion) are formed so as to be spherical or substantially spherical, and also the leg rest 128 is covered with shock-absorbing material 128*d*, so the comfort of the operator can be improved. Note that the support 126*a* of the waist holder 126 may also be covered with shock-absorbing material.

In addition, while the support 126*a* is formed herein by bending or curving a cylindrical member, this is not a limitation, as it may also take the form of a back rest (back support). The shape of the leg rest 128 is similarly not limited to that described above.

In addition, underwater scooter 10 is provided with the depth adjusting mechanism 18 so the depth of travel can be easily adjusted, thus further reducing the burden on the operator OP. Moreover, the depth adjusting mechanism 18 comprises left and right grips 102L and 102R to be held onto by the operator and operated along with left and right elevators 104L and 104R connected thereto, so the operator is able to adjust the depth of travel while holding onto the grips 102L and 102R to stabilize their posture, and thus the burden on the operator can be reduced even further.

In addition, the underwater scooter 10 is provided with the steering mechanism 20 so the direction of forward motion can be easily adjusted, and thus the burden on the operator can be reduced even further. Moreover, the steering mechanism 20 comprises the foot stand 114 that is to be operated with the feet of the operator and the rudder 116 connected thereto, so the operator is able to adjust the direction of forward motion while placing their feet on the foot stand 114 to stabilize their posture, and thus the burden on the operator can be reduced even further.

In addition, the footrest 114*a* of the foot stand 114 is annular in shape so the operator OP can rest their feet upon the footrest 114*a*, and thus the operation of the foot stand 114 (namely, the adjustment of the direction of forward motion of the underwater scooter 10) can be performed easily.

In addition, the first and second air tanks 22 and 24 can slide freely in the direction of forward motion of the underwater scooter 10, so the position at which their buoyancy acts can be varied to achieve a suitable posture whether the underwater scooter 10 is diving or surfacing.

In addition, within the interior of the main frame 12 are formed the first passage 12*a* through which passes the driveshaft 26 serving as the motive power transmission system, the second passage 12*b* serving as the air intake system for the engine E, the third passage 12*c* serving as the system for supplying air for breathing to the operator OP, the fourth passage 12*d* serving as the exhaust system for the engine E, and the fifth passage 12*e* serving as the internal pressure regulation system for the watertight vessel 14 (the space enclosing the engine E), so each of these systems can be disposed in a compact manner and also the constitution is simplified, and thus the ease of assembly and maintenance work can be improved.

In addition, the first one-way check valve 94 that opens when the internal pressure exceeds a stipulated pressure, thereby allowing the fourth passage 12*d* to communicate with the outside, is disposed upon the fourth passage 12*d*, so the intrusion of water into the fourth passage 12*d* can be prevented.

In addition, the second one-way check valve 96 that opens when the internal pressure exceeds a stipulated pressure, thereby allowing the fifth passage 12*e* to communicate with the outside, is disposed upon the fifth passage 12*e*, so the intrusion of water into the fifth passage 12*e* can be prevented.

In addition, the output of the engine E is transmitted to the propeller 16 via the centrifugal clutch 84, so the motion of the underwater scooter 10 can be halted without stopping the operation of the engine E.

Note that in the above embodiment, if the assumption is made that the depth of travel of the underwater scooter 10 is shallow (upon or near the surface of the water) so the upper end of the snorkel 48 is positioned above the surface of the water, for example, then the second passage 12*b* formed in the interior of the main frame 12 can be omitted.

In addition, the snorkel 48 may be connected to the mouthpiece 76 so if the depth of travel of the underwater scooter 10 is shallow, the air for breathing by the operator can also be introduced from outside. In this case, the third passage 12*c* formed in the interior of the main frame 12 may also be omitted. The same goes in the case that the operator is wearing an air tank containing air for breathing.

As mentioned in the embodiment described below, a one-way check valve may be provided on the starter grip 92, thus exhausting the air within the watertight vessel 14 from there into the outside, and in this case, the fifth passage 12*e* formed in the interior of the main frame 12 may be omitted.

In this manner, depending on the application of the underwater scooter 10, it need not be necessary to form all of the first through fifth passages 12*a*, 12*b*, 12*c*, 12*d* and 12*e* in the interior of the main frame 12. However, if at least two passages constituting different systems are formed in the interior of the main frame 12, then the systems can be disposed in a compact manner and the meritorious effects of simplified constitution and improved ease of assembly and maintenance work can be obtained. This is the intent of "forming at least two passages" as recited in the claims.

Here follows a description of an underwater scooter according to a second embodiment of the invention. In the second embodiment, the ride-on underwater scooter described in the first embodiment is made so that it is freely convertible into a tow-behind configuration.

First, details of the components of the ride-on underwater scooter 10 described in the first embodiment will be described with reference to FIGS. 16 and 17. Note that in the second embodiment, the aforementioned main frame 12 will be called the "ride-on main frame" and the driveshaft 26 will be called the "ride-on driveshaft."

Figure 16:
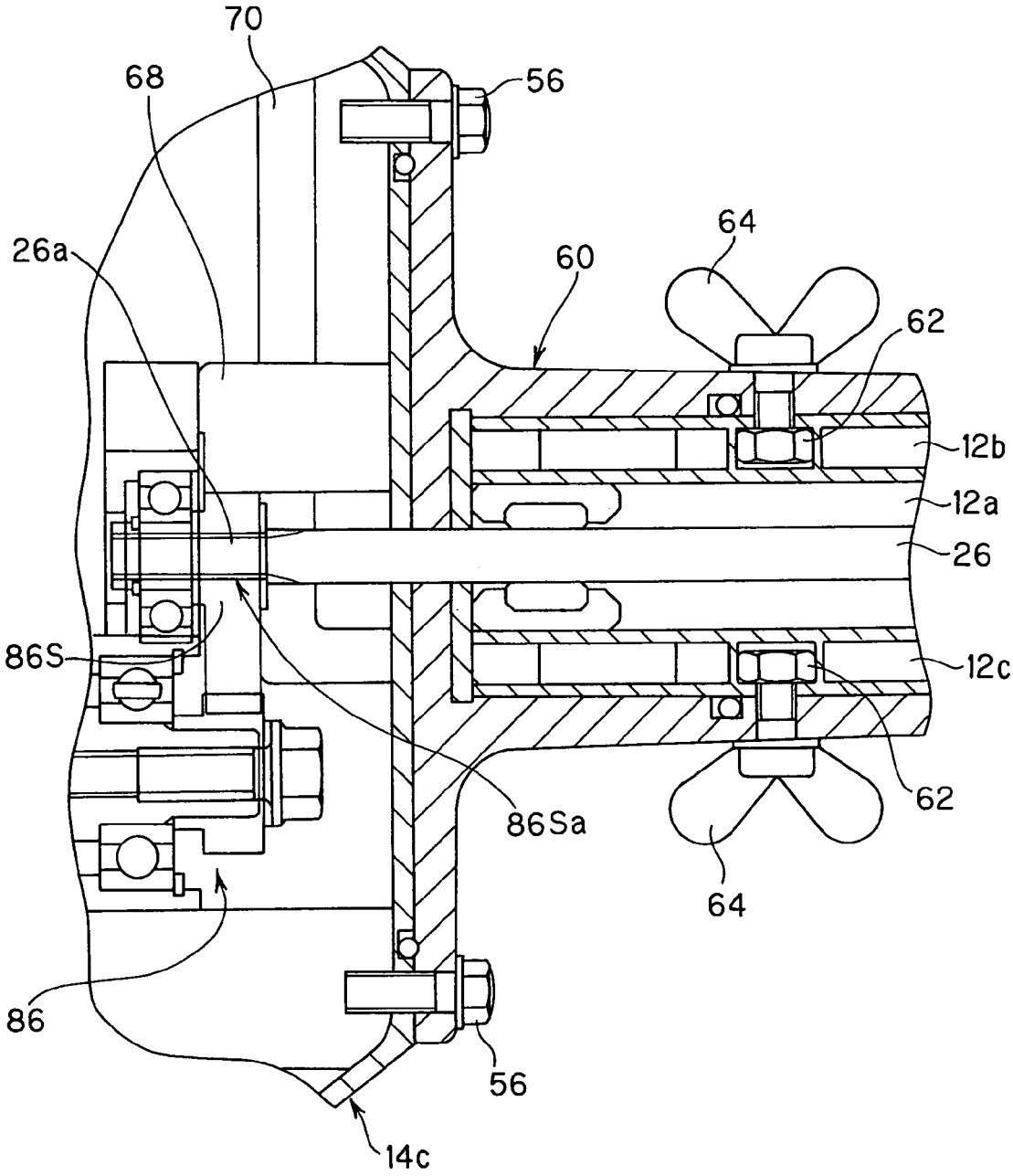
FIG. 16 is a cross-sectional enlargement of a modification to a portion of FIG. 5, according to a second embodiment of the invention.

FIG. 16 is an enlargement of a portion of FIG. 5 shown in the first embodiment. As shown in FIG. 16, a polygonal (polygonal when viewed in cross section) hole 86Sa is formed in the center of the output shaft (gear) 86S of the reduction gear mechanism 86. In addition, a polygonal (when viewed in cross section) fore end insertion tang 26*a* is formed upon the fore end of the ride-on driveshaft 26 so as to fit when inserted into this hole 86Sa. Specifically, by inserting and fitting the fore end insertion tang 26*a* of the ride-on driveshaft into the hole 86Sa formed in the output shaft of the reduction gear mechanism, the output shaft of the reduction gear mechanism 86 is connected to the fore end of the ride-on driveshaft 26.

Figure 17:
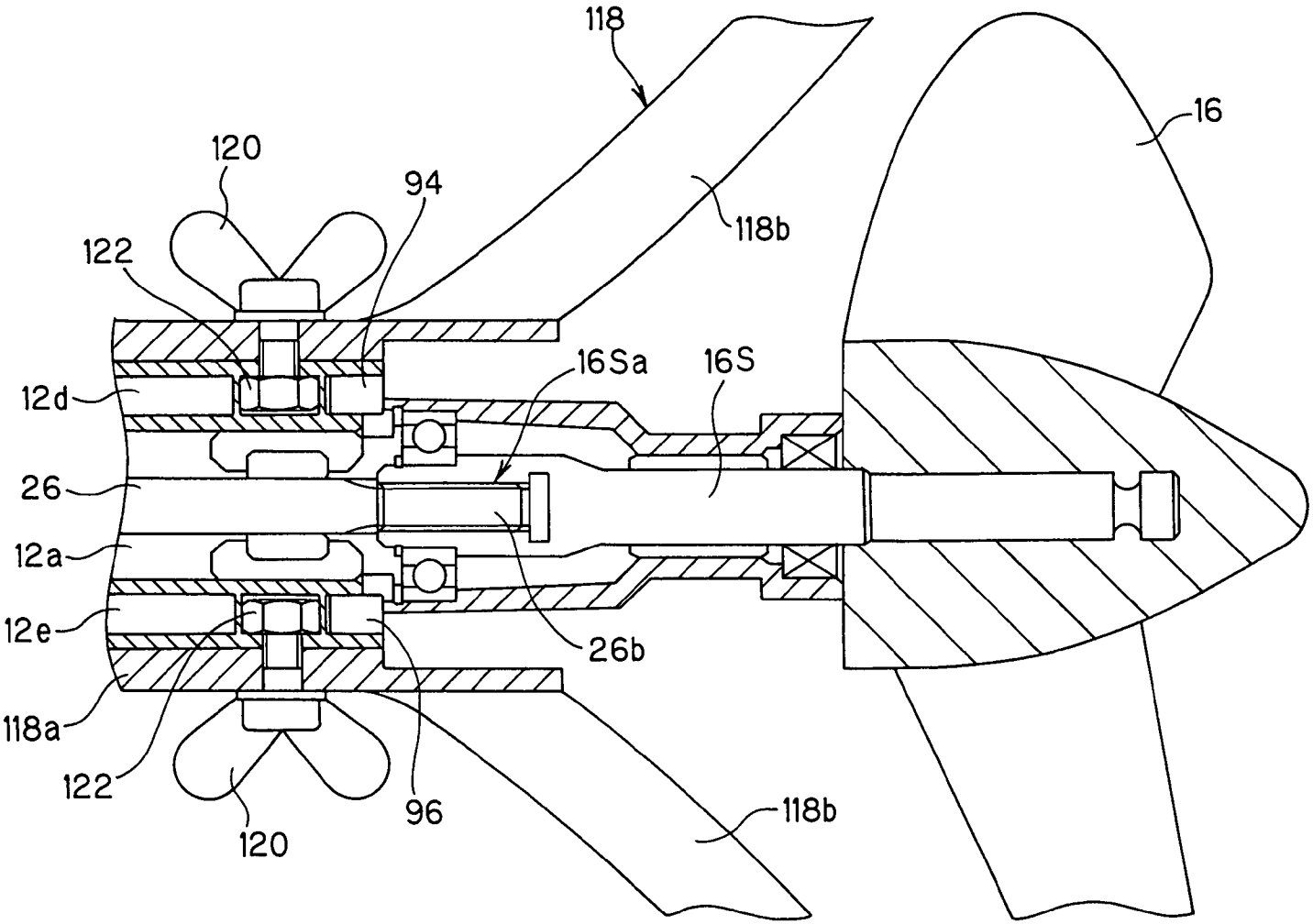
FIG. 17 is an enlargement of a portion of FIG. 10.

FIG. 17 is an enlargement of a portion of FIG. 10 shown in the first embodiment.

As shown in FIG. 17, a polygonal (when viewed in cross section) hole 16Sa is formed in the propeller shaft 16S of the propeller 16. In addition, a polygonal (when viewed in cross section) aft end insertion tang 26*b* is formed upon the aft end of the ride-on driveshaft 26 so as to fit when inserted into this hole 16Sa. Specifically, by inserting and fitting the aft end insertion tang 26*b* of the ride-on driveshaft into the hole 16Sa formed in the propeller shaft, the aft end of the ride-on driveshaft 26 is connected to the propeller 16.

Figure 18:
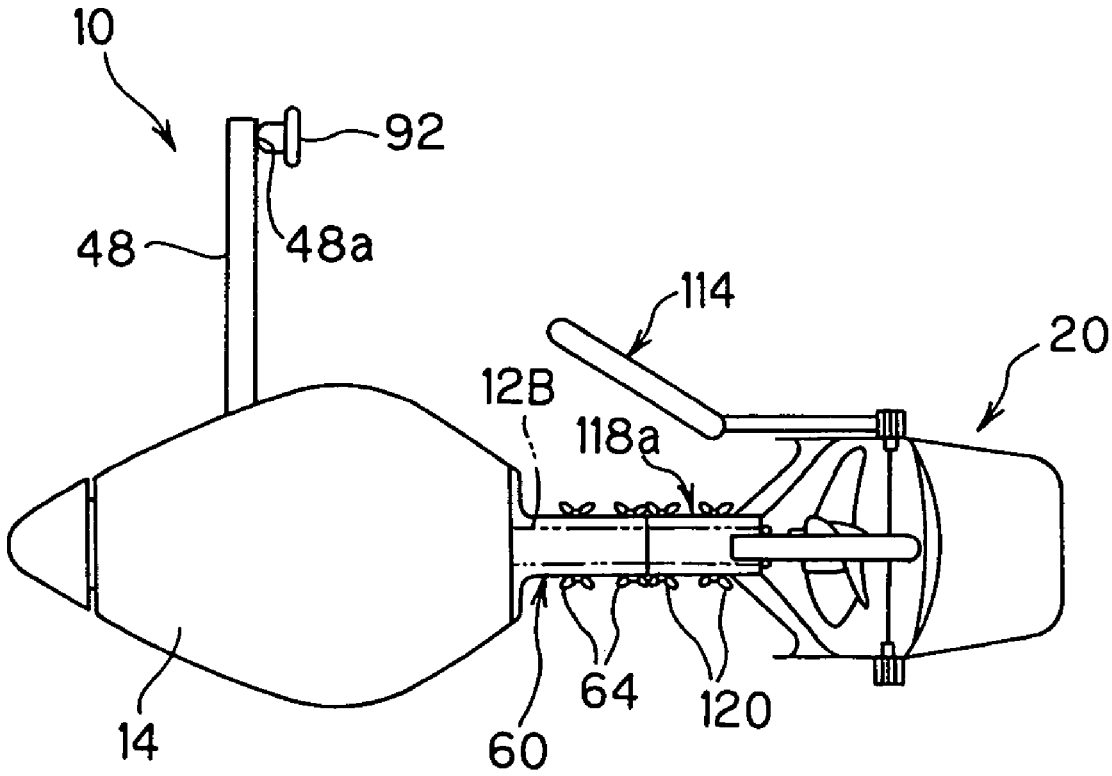
FIG. 18 is a left-side view of the underwater scooter when changed into the tow-behind configuration of the second embodiment.
Figure 19:
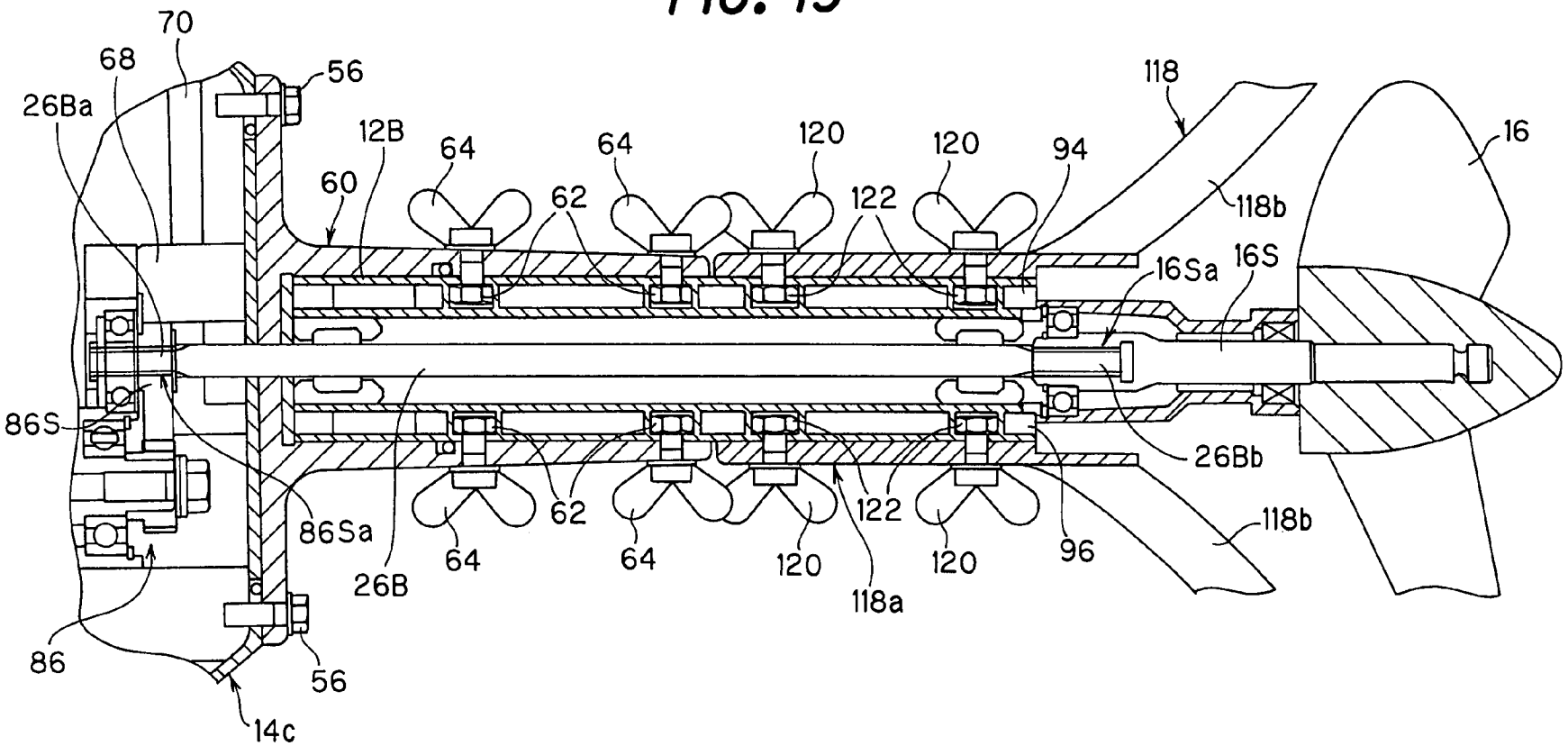
FIG. 19 is a cross-sectional enlargement of a portion of the underwater scooter shown in FIG. 18.
Figure 20:
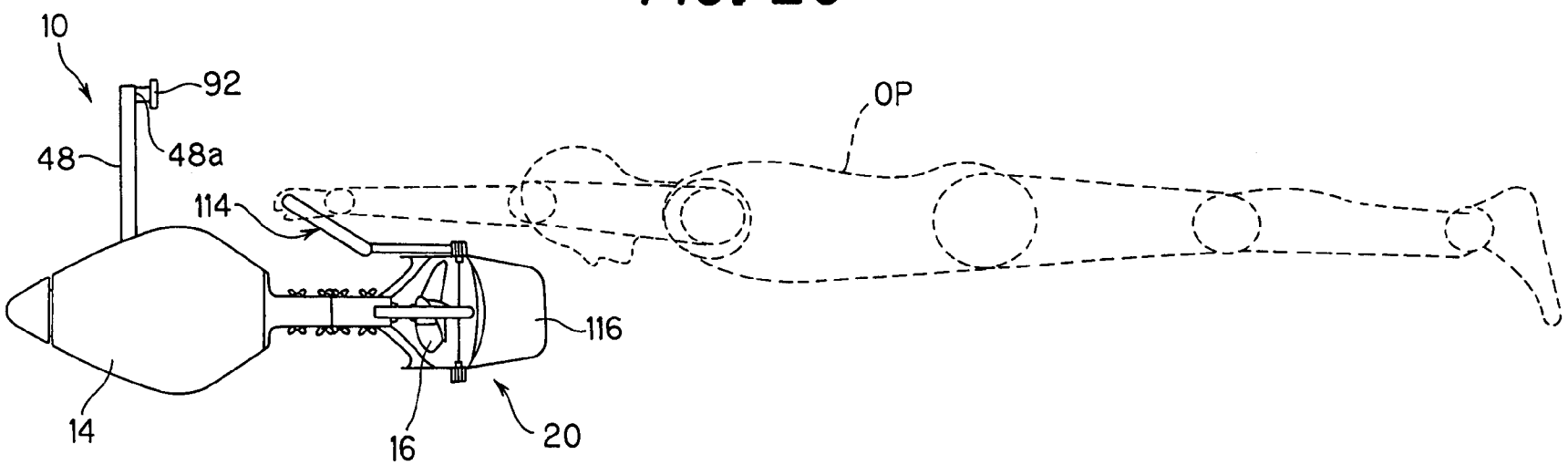
FIG. 20 is a side view showing the underwater scooter in the tow-behind configuration, with the operator being towed thereby, of the second embodiment.

Here follows a description of the constitution when the underwater scooter 10 is changed into a tow-behind configuration, made with reference to FIG. 18 to FIG. 20.

In this embodiment, in addition to the ride-on main frame 12 described above, a tow-behind main frame (second or auxiliary main frame) formed so as to have a shorter length in the direction of forward motion is provided, and the ride-on main frame 12 and tow-behind main frame are made to be interchangeable. In addition, in addition to the ride-on driveshaft 26, a tow-behind driveshaft (second or auxiliary driveshaft) formed so as to have a shorter length in the direction of forward motion is provided, and the ride-on driveshaft 26 and tow-behind driveshaft are made to be interchangeable. Note that when the underwater scooter 10 is in the tow-behind configuration, it is assumed to travel upon or near the surface of the water.

FIG. 18 is a left-side view of the underwater scooter 10 when changed into the tow-behind configuration.

As shown in FIG. 18, when the underwater scooter 10 is in the tow-behind configuration, the ride-on main frame 12 is replaced with a tow-behind main frame 12B with a shorter length in the direction of forward motion. The wing bolts 64 described above are used to mount the connecting member 60 and watertight vessel 14 before the tow-behind main frame 12B, and also the wing bolts 120 described above are used to mount the steering mechanism 20 aft of the main frame.

The steering mechanism 20 is mounted upside-down in comparison to when mounted to the ride-on main frame 12. Specifically, when the underwater scooter 10 is in the ride-on configuration, the steering mechanism 20 is mounted so that the foot stand 114 is disposed below the ride-on main frame 12, but in the tow-behind configuration, it is mounted so that the foot stand 114 is disposed above the tow-behind main frame 12B.

Note that the watertight vessel 14 and steering mechanism 20 are mounted to either of the main frames 12 or 12B by screwing wing bolts 64 and 120 into the nuts 62 and 122 that are kept from turning as described above, so no tools or the like are required when switching out the main frame.

FIG. 19 is an enlargement of a portion of the underwater scooter shown in FIG. 18.

As shown in FIG. 19, the tow-behind main frame 12B is formed such that its length in the direction of forward motion is substantially equal to the sum of the lengths of the connecting member 60 into which its fore end is inserted and the cylindrical portion 118*a* into which its aft end is inserted. Specifically, the watertight vessel 14 and steering mechanism 20 are disposed adjacent to each other, and thus the underwater scooter 10 in the tow-behind configuration is more compact (its overall length is shortened) than when in the ride-on configuration.

The tow-behind driveshaft 26B that transmits the output of the engine E to the propeller 16 passes through the tow-behind main frame 12B. A fore end insertion tang 26Ba with a polygonal shape when viewed in cross section like that of the ride-on driveshaft 26 is formed upon the fore end of the ride-on driveshaft 26B so as to fit into the hole 86Sa formed on the output shaft of the reduction gear mechanism. In addition, an aft end insertion tang 26Bb with a polygonal shape when viewed in cross section is formed upon the aft end of the ride-on driveshaft 26B so as to fit into the hole 16Sa in the propeller shaft 16S.

In this manner, except for the main frame and driveshaft, the main components comprising the engine E and the watertight vessel 14 that encloses it, and the propeller 16 and steering mechanism 20 are common to both the ride-on and tow-behind configurations.

FIG. 20 is a side view showing the underwater scooter 10 in the tow-behind configuration and the operator being towed by it.

As shown in FIG. 20, the operator OP uses both hands to grip the foot stand 114 and be towed. The foot stand 114 is connected to the rudder 116 as described above, so if the operator OP uses both hands to move the foot stand 114 left or right, the underwater scooter 10 can be easily steered.

In addition, as described above, the underwater scooter 10 in the tow-behind configuration is assumed to travel upon or near the surface of the water. Accordingly, as shown in the figure, when the underwater scooter 10 is in the tow-behind configuration, the aforementioned air tanks 22 and 24 are not used and the starter grip 92 is kept in the notch 48*a* of the snorkel 48, so outside air can be taken in as air for combustion in the engine E.

In addition, for the same reason, the depth adjusting mechanism 18 and the hose 72, regulator 74 and mouthpiece 76 that supply air for breathing to the operator OP are also not used, so these are all removed from the watertight vessel 14.

Note that like the ride-on main frame 12, the tow-behind main frame 12B similarly has its interior divided by partition walls to form five passages. However, the air tanks 22 and 24 are not used in the tow-behind configuration so the second passage and third passage may be omitted from the tow-behind main frame 12B.

In this manner, with the underwater scooter 10 according to the second embodiment of the invention, the tow-behind main frame 1 2B formed so as to be shorter than the ride-on main frame 12 and the tow-behind driveshaft 26B formed so as to be shorter than the ride-on driveshaft 26 are provided, and the ride-on main frame 12 and ride-on driveshaft 26 are freely interchangeable with the tow-behind main frame 12B and tow-behind driveshaft 26B, respectively, so the underwater scooter 10 can be made more compact (with a shorter overall length), and thus its maneuverability can be improved in addition to the meritorious effects described for the first embodiment.

Specifically, the underwater scooter 10 is made usable in either the ride-on configuration wherein the operator rides on it or the tow-behind configuration wherein the operator is towed by it, so the two contrary advantages of reduced burden on the operator accompanying larger size and improved maneuverability accompanying smaller size can be obtained selectively.

The main components comprising the engine E and the watertight vessel 14 that encloses it, and the propeller 16 and steering mechanism 20 are made common to both the ride-on and tow-behind configurations, so the constitution can be simplified.

In addition, the underwater scooter 10 is provided with the steering mechanism 20 that is controlled by the feet of the operator OP in the ride-on configuration and controlled by the hands of the operator OP in the tow-behind configuration, so the underwater scooter 10 can be easily steered regardless of whether the underwater scooter 10 is in the ride-on configuration or the tow-behind configuration, and thus the burden on the operator can be reduced and also the maneuverability can be improved.

Here follows a description of an underwater scooter according to a third embodiment of the invention.

In the third embodiment, the watertight vessel 14 is mounted to either of the main frames 12 or 12B by means of a manually operable ratchet mechanism. Note that the constitution of the ratchet mechanism is the same in the ride-on main frame 12 and the tow-behind main frame 12B, so mounting to the ride-on main frame 12 will be used as an example in the explanation below.

Figure 21:
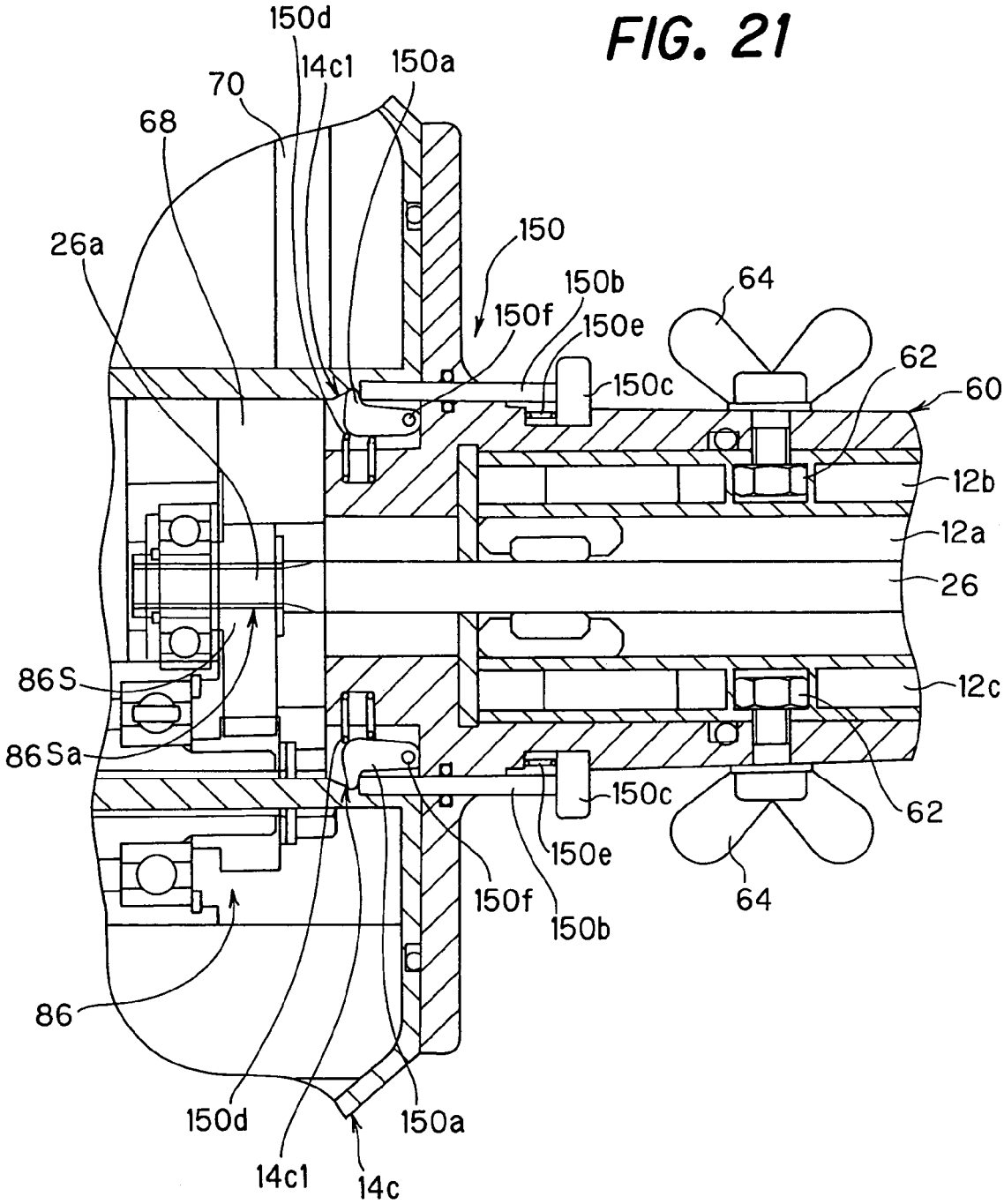
FIG. 21 shows the underwater scooter according to a third embodiment of the invention, as a partial cross section similar to that of FIG. 16.

FIG. 21 shows the underwater scooter according to the third embodiment as a partial cross section similar to that of FIG. 16.

The symbol 150 in FIG. 21 indicates the ratchet mechanism. As shown in the figure, the ratchet mechanism 150 comprises two ratchets 150*a*, two pushrods 150*b*, push rings 150*c*, first springs 150*d* and second springs 150*e*, all of which are provided on the aforementioned connecting member 60.

The pawls of the two ratchets 150*a* are able to rotate around pawl pins 150*f* and are also biased by the first springs 150*d* to engage indentations 14*c*1 formed in the engine enclosure 14*c*.

Specifically, in the third embodiment, the bolts 56 described in the second embodiment are replaced by the ratchets 150*a* that engage the engine enclosure 14*c*, thus mounting the connecting member 60 to the engine enclosure 14*c*.

Note that the pushrods 150*b* have one end in contact with the pawls of the ratchets 150*a* and the other end in contact with the push rings 150*c*. In addition, the push rings 150*c* are biased by the second springs 150*e* in the direction of separation from the pawls of the ratchets 150*a* (in the direction in which the pawls of the ratchets 150*a* are not pushed by the pushrods 150*b*).

Here follows a description of disengaging the connecting member 60 from the engine enclosure 14*c*.

When pushed by the operator in the direction such that the push rings 150*c* approach the pawls of the ratchets 150*a*, the pawls of the ratchets 150*a* are pushed via the pushrods 150*b*.

When the pawls of the ratchets 150*a* are pushed, the ratchets 150*a* rotate against the biasing force of the first springs 150*d* and thus the pawls of the ratchets 150*a* are released from their engagement to the indentations 14*c*1 formed in the engine enclosure. Thereby, the connecting member 60 can be removed from the engine enclosure 14*c*.

Specifically, in the third embodiment, the engagement or disengagement of the watertight vessel 14 to the ride-on main frame 12 is not performed by engaging or disengaging the ride-on main frame 12 to the connecting member 60 as in the first embodiment, but rather it is performed by engaging or disengaging the engine enclosure 14*c* to the connecting member 60. Moreover, the engagement or disengagement of the engine enclosure 14*c* to the connecting member 60 is performed by means of the manually operable ratchet mechanism 150 comprising the ratchets 150*a*, push rings 150*c* and the like. This is the same for the tow-behind main frame 12B.

In this manner, in the third embodiment, the watertight vessel 14 is mounted to either of the main frames 12 or 12B by means of the manually operable ratchet mechanism 150, so no tools or the like are required when switching out the main frame, and thus the work of switching out the main frame can be performed easily.

Note that the remainder of the constitution is the same as in the second embodiment, so a description thereof is omitted. However, in the third embodiment, there is no need to engage or disengage the connecting member 60 to either of the main frames 12 or 12B, so the connecting member 60 may be formed as a unit with the respective main frames 12 or 12B.

Here follows a description of an underwater scooter according to a fourth embodiment of the invention. The underwater scooter according to the fourth embodiment is provided with indicator means that indicates the amount of air remaining in the aforementioned first air tank 22 and second air tank 24.

Figure 22:
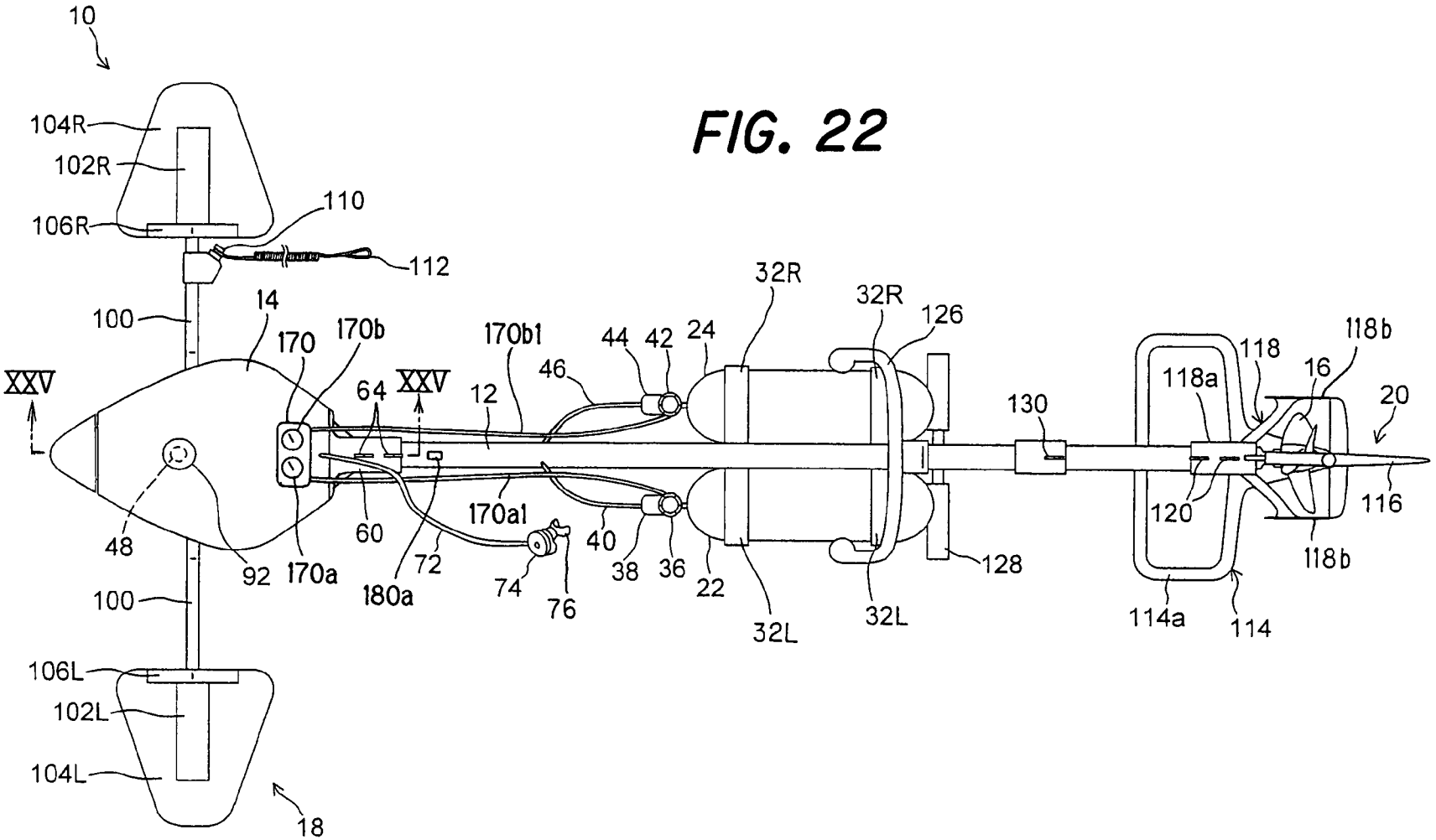
FIG. 22 is a top view of an underwater scooter according to a fourth embodiment of the invention.

FIG. 22 is a top view of an underwater scooter according to the fourth embodiment of the invention. In addition, FIG. 23 is a left side view of the underwater scooter shown in FIG. 22.

Figure 23:
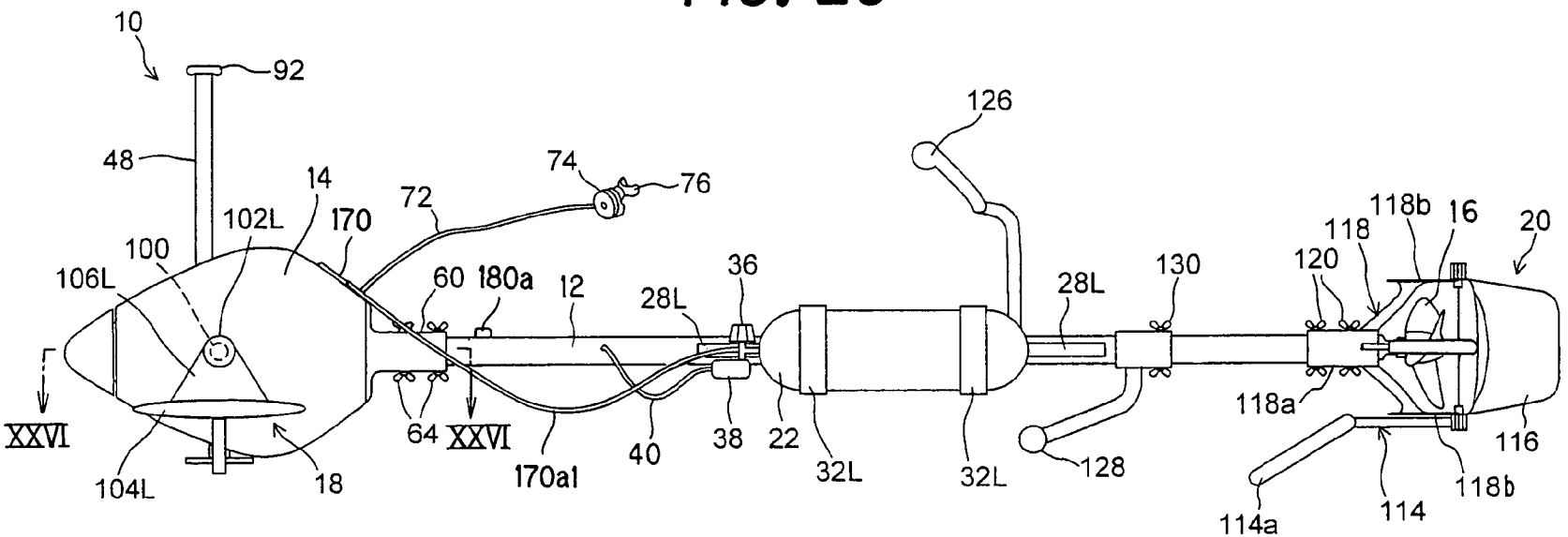
FIG. 23 is a left side view of the underwater scooter shown in FIG. 22.
Figure 24:
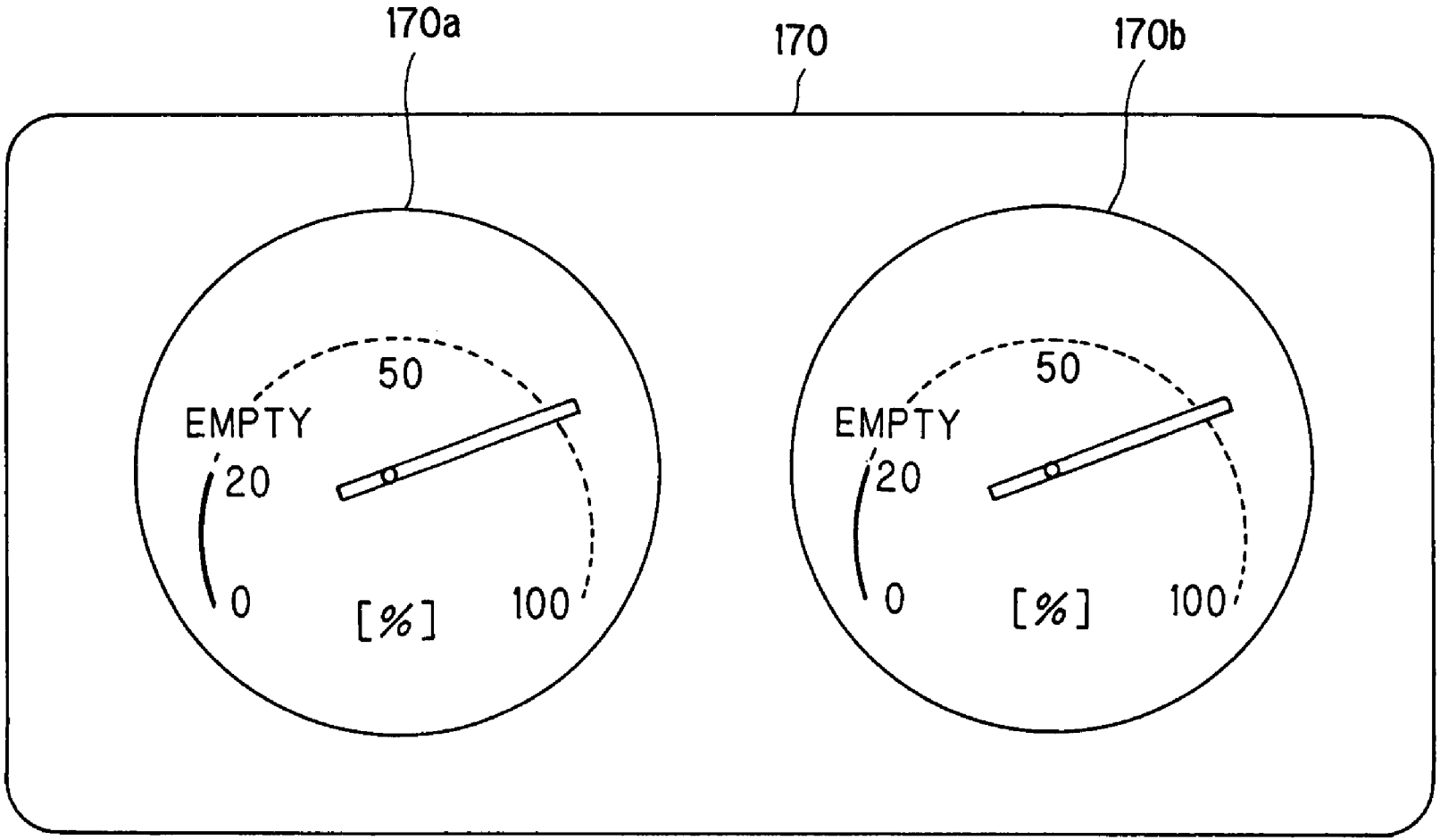
FIG. 24 is a plan view of an instrument panel shown in FIG. 22.

As shown in FIG. 22 and FIG. 23, an instrument panel 170 is provided upon the upper surface of the watertight vessel 14. As illustrated clearly in FIG. 24, upon the instrument panel 170 are disposed a first pressure gage 170*a* (first remaining air indicator means) used to detect and indicate the amount of air remaining in the first air tank 22 and a second pressure gage 170*b* (second remaining air indicator means) used to detect and indicate the amount of air remaining in the second air tank 24. Specifically, the first pressure gage 170*a* is connected via a high-pressure hose 170*a*1 to the first air tank 22 and indicates the amount of air remaining in the first air tank 22 as a percentage depending on its outlet air pressure. In addition, the second pressure gage 170*b* is connected via a high-pressure hose 170*b*1 to the second air tank 24 and indicates the amount of air remaining in the second air tank 24 as a percentage depending on its outlet air pressure.

Figure 25:
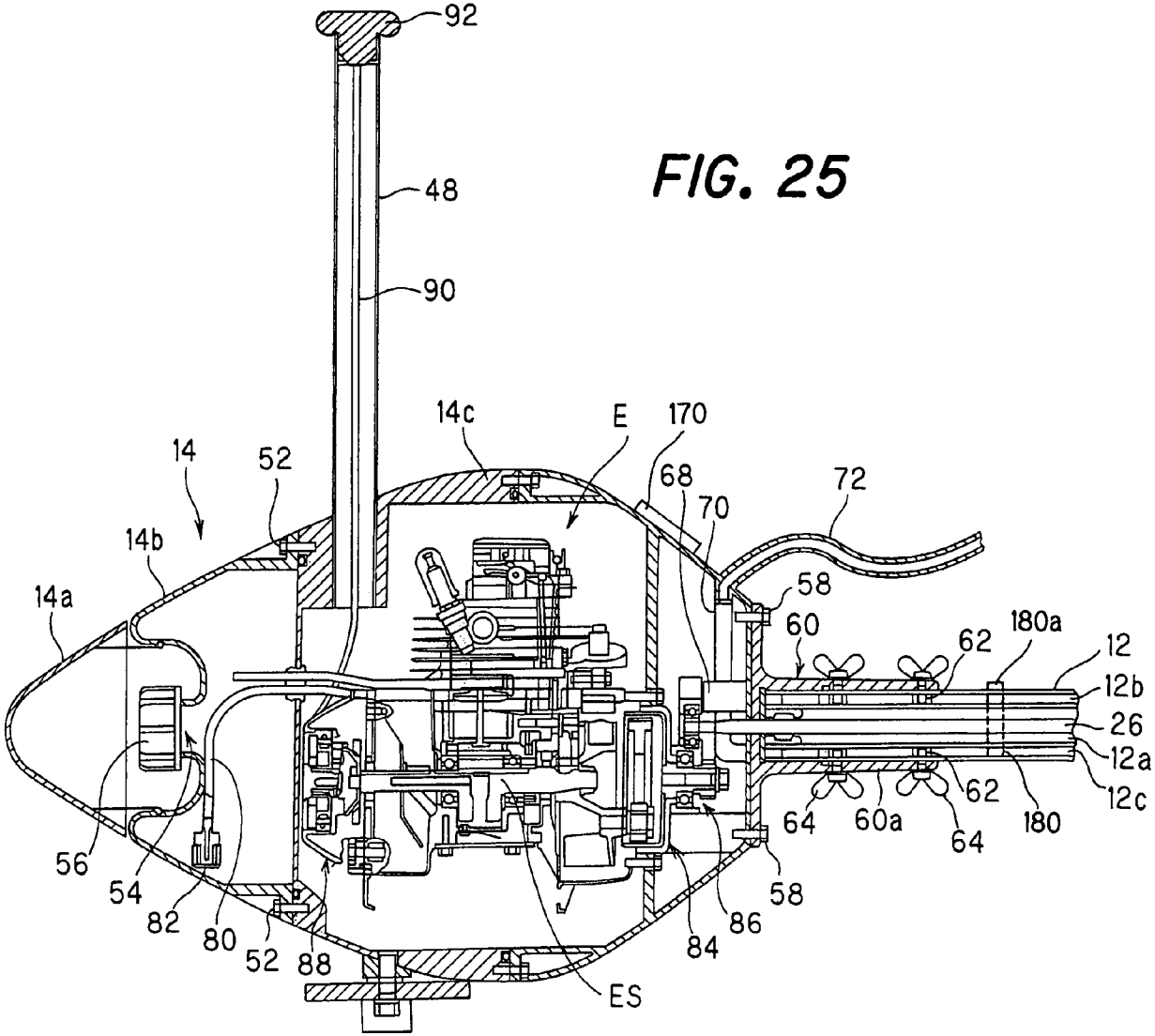
FIG. 25 is an enlarged cross section along the line XXV—XXV in FIG. 22.

FIG. 25 is an enlarged cross section along the line XXV—XXV in FIG. 22. In addition, FIG. 26 is an enlarged cross section along the line XXVI—XXVI in FIG. 23.

Figure 26:
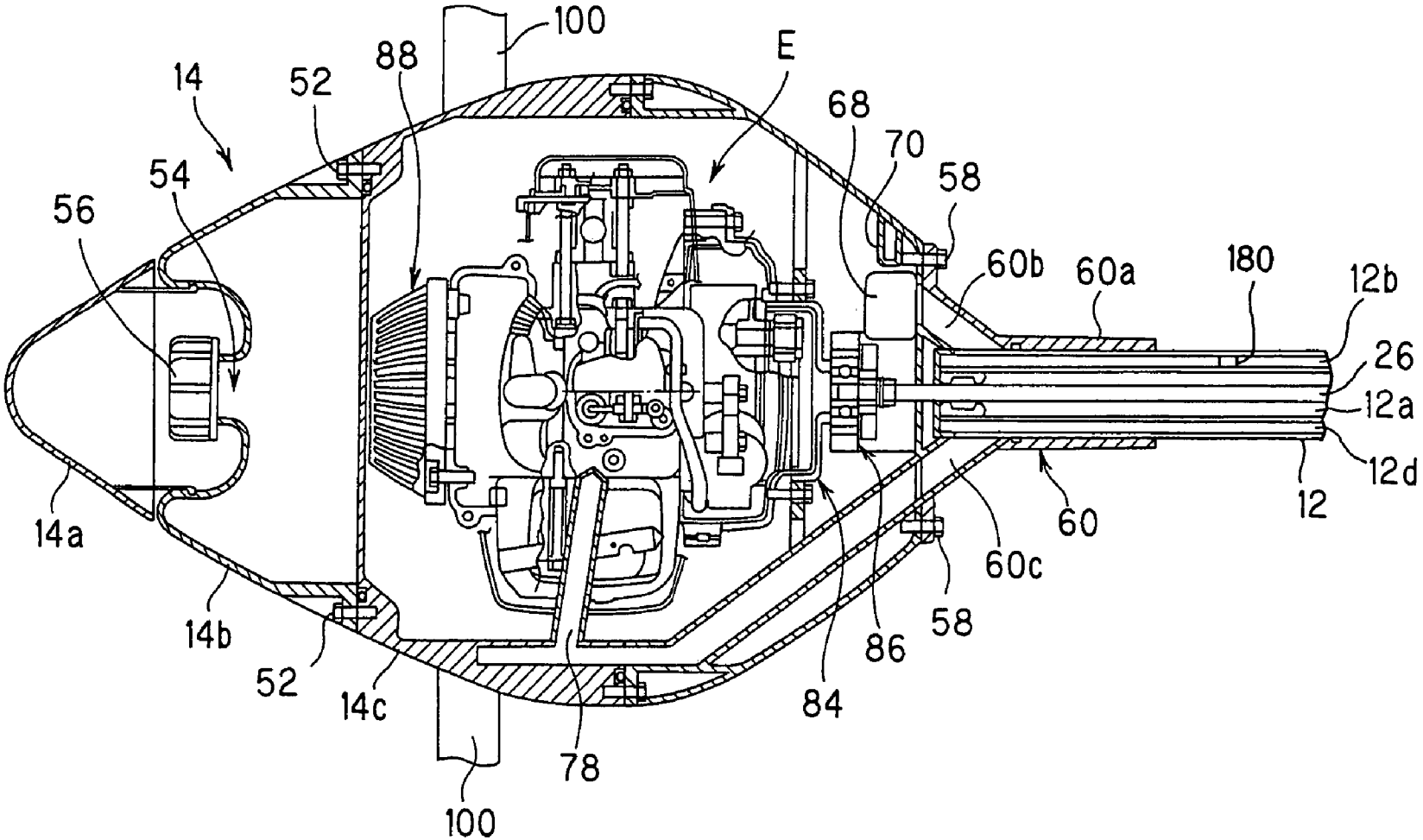
FIG. 26 is an enlarged cross section along the line XXVI—XXVI in FIG. 23.

As shown in FIG. 25 and FIG. 26, a switchover valve 180 (air supply destination changing means) is disposed on the second passage 12*b* and third passage 12*c*. The switchover valve 180 is provided with a switchover switch 180*a* that can be manually operated by the operator, and by operating this switch 180*a*, the portion of the second passage 12*b* upstream of the switchover valve 180 is made to communicate with the portion of the third passage 12*c* downstream of it, and also, the portion of the third passage 12*c* upstream of the switchover valve 180 is made to communicate with the portion of the second passage 12*b* downstream of it.

Specifically, the switchover valve 180 changes the destinations to which the air contained in the first and second air tanks 22 and 24 is supplied depending on the position of the switchover switch 180*a*. Specifically, the destinations to which the air contained in the first and second air tanks is supplied are changed so that the air contained in the first air tank 22 is supplied to the operator as air for breathing and also, the air contained in the second air tank 24 is supplied to the engine E as air for combustion.

In this manner, the underwater scooter according to the fourth embodiment of the invention is provided with the first pressure gage 170*a* that indicates the amount of air remaining in the first air tank 22 and the second pressure gage 170*b* that indicates the amount of air remaining in the second air tank 24, so the operator can be notified of the amount of time (distance) that the underwater scooter 10 can travel submerged and the amount of time the operator OP can remain submerged (breathing time).

Moreover, the switchover valve 180 that changes the destinations to which the air contained in the first air tank 22 and the second air tank 24 is provided, so even if a difference arises between the rate of consumption of air for combustion and air for breathing, the air contained in the air tanks can be used efficiently.

Note that while a single switchover valve is used to change the destinations to which the air contained in both the first air tank 22 and the second air tank 24 is supplied, different switchover valves may also be used to change the destinations to which the air contained in the air tanks is supplied. In addition, it is also possible to change only one destination to which air is supplied.

For example, by providing a switchover valve that changes the destination to which the air contained in the first air tank 22 is supplied so that it is supplied to the operator, even in the case that no second air tank 24 is provided, when the engine E is halted or when the depth of travel of the underwater scooter 10 is shallow and air for combustion can be introduced from the snorkel 48, it is possible to supply air for breathing to the operator, thus increasing the comfort of the operator. In addition, by providing a switchover valve that changes the destination to which the air contained in the second air tank 24 is to be supplied so that it is supplied to the watertight vessel 14 (engine E), the meritorious effect of extending the amount of time (distance) that the underwater scooter 10 can travel submerged can be obtained. This is the intent of referring to the means of changing the destination to which the air contained in the first air tank is to be supplied so that it is supplied to the operator as the "first air-destination changer" and to the means of changing the destination to which the air contained in the second air tank is to be supplied so that it is supplied to the interior of the watertight vessel as the "second air-destination changer" as recited in the claims mentioned below.

Figure 27:
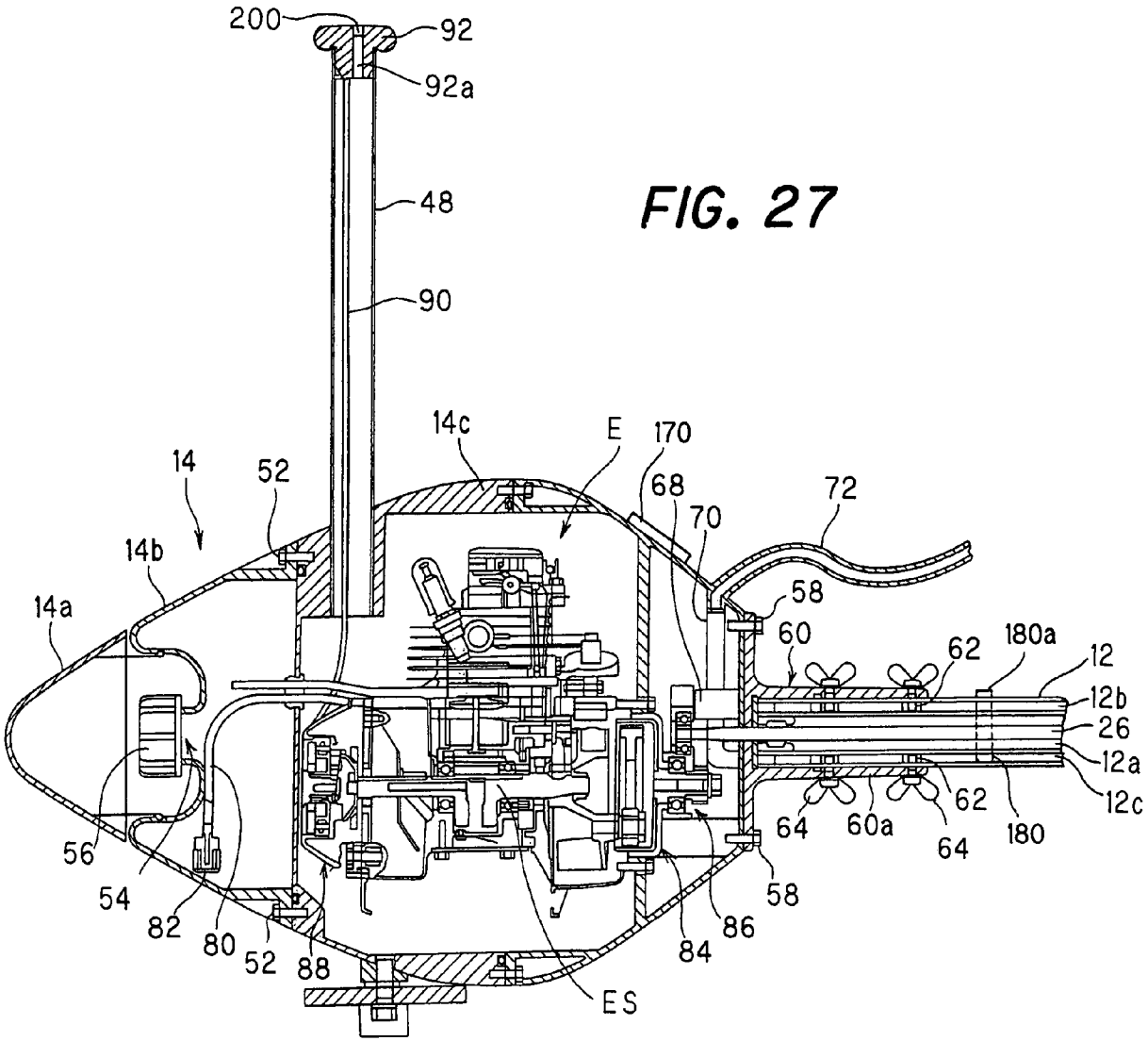
FIG. 27 is a cross section of an underwater scooter according to a fifth embodiment.

Here follows a description of an underwater scooter according to a fifth embodiment of the invention. FIG. 27 is a cross section of an underwater scooter according to the fifth embodiment.

The fifth embodiment is constituted such that a third one-way check valve 200 is disposed upon the starter grip 92 of the recoil starter 88. Specifically, a through hole 92*a* is cut through the starter grip 92 and the third one-way check valve 200 is disposed in this through hole 92*a*.

In the same manner as the second one-way check valve 96 described in the first embodiment, the third one-way check valve 200 opens when the internal pressure of the snorkel 48 (in other words, the internal pressure of the watertight vessel 14 with which the snorkel 48 communicates) exceeds a stipulated pressure, allowing the snorkel 48 to communicate with the outside (atmosphere or underwater). Specifically, when the internal pressure of the watertight vessel 14 rises due to heat from the engine E or the like, the air within the watertight vessel 14 is exhausted via the snorkel 48 and the third one-way check valve 200 to the area above (outside) the underwater scooter 10, and thus the internal pressure of the watertight vessel 14 is regulated (depressurized).

In this manner, with the underwater scooter 10 according to the fifth embodiment, the third one-way check valve 200 that opens when the internal pressure of the watertight vessel 14 exceeds a stipulated pressure, allowing the watertight vessel 14 to communicate with the outside, is disposed upon the starter grip 92 that seals the opening of the snorkel 48, and thus regulation of the internal pressure of the watertight vessel 14 (depressurization) is possible.

Note that the remainder of the constitution is the same as in the first embodiment, so a description thereof is omitted. However, when the third one-way check valve 200 is disposed in the starter grip 92, the fifth passage 12*e* and second one-way check valve 96 described in the first embodiment may be omitted.

Here follows a description of an underwater scooter according to a sixth embodiment of the invention.

Figure 28:
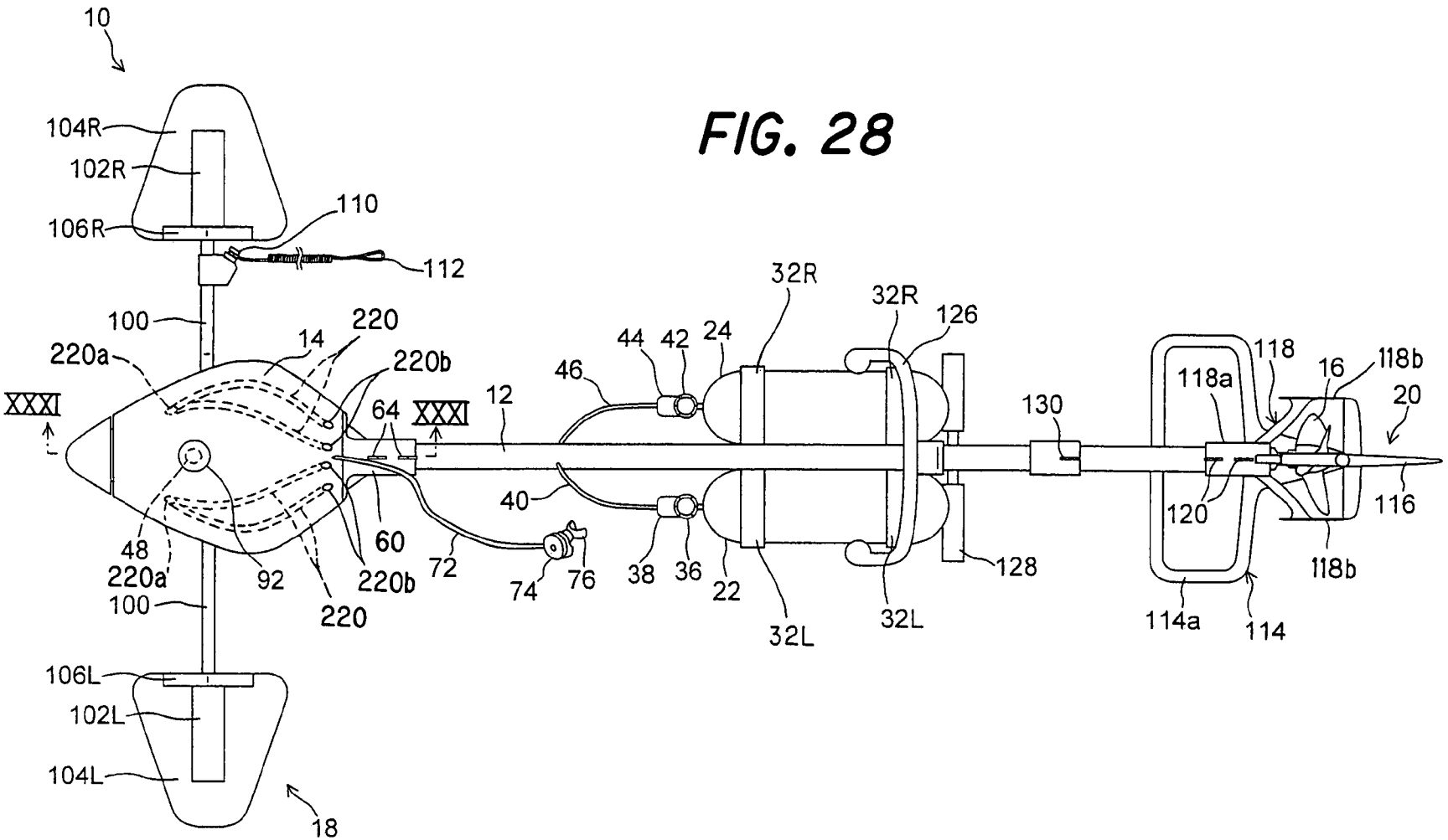
FIG. 28 is a top view of an underwater scooter according to a sixth embodiment of the invention.
Figure 29:
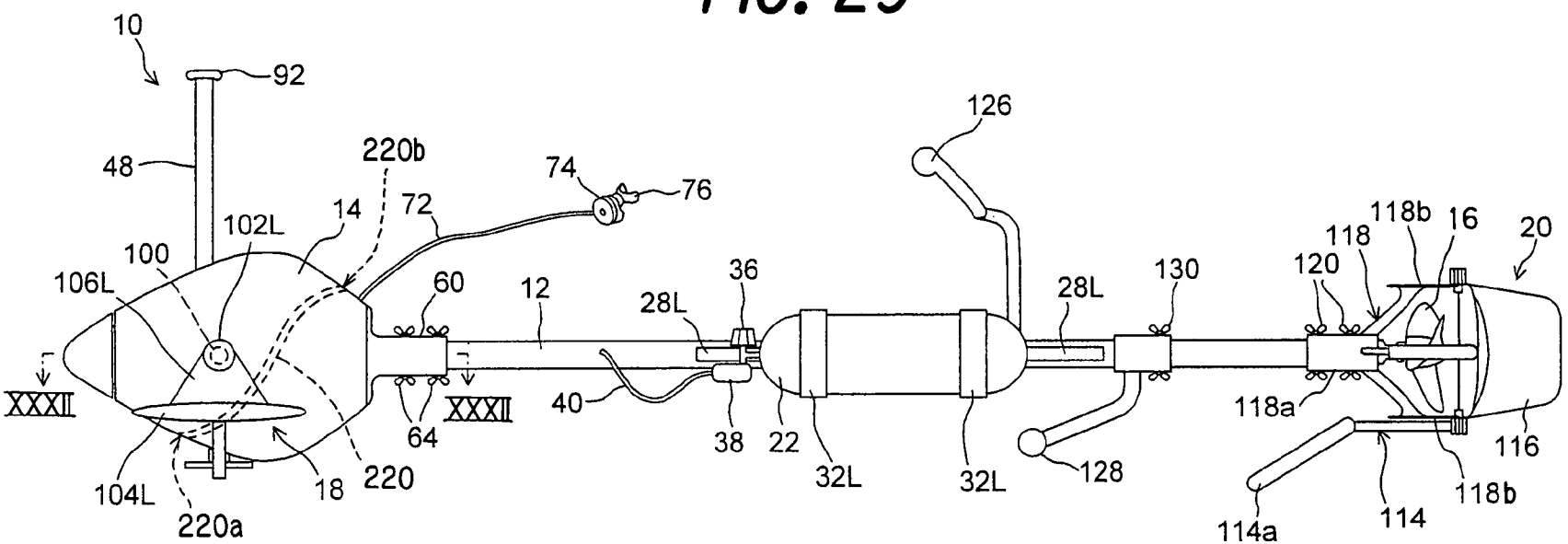
FIG. 29 is a left side view of the underwater scooter shown in FIG. 28.
Figure 30:
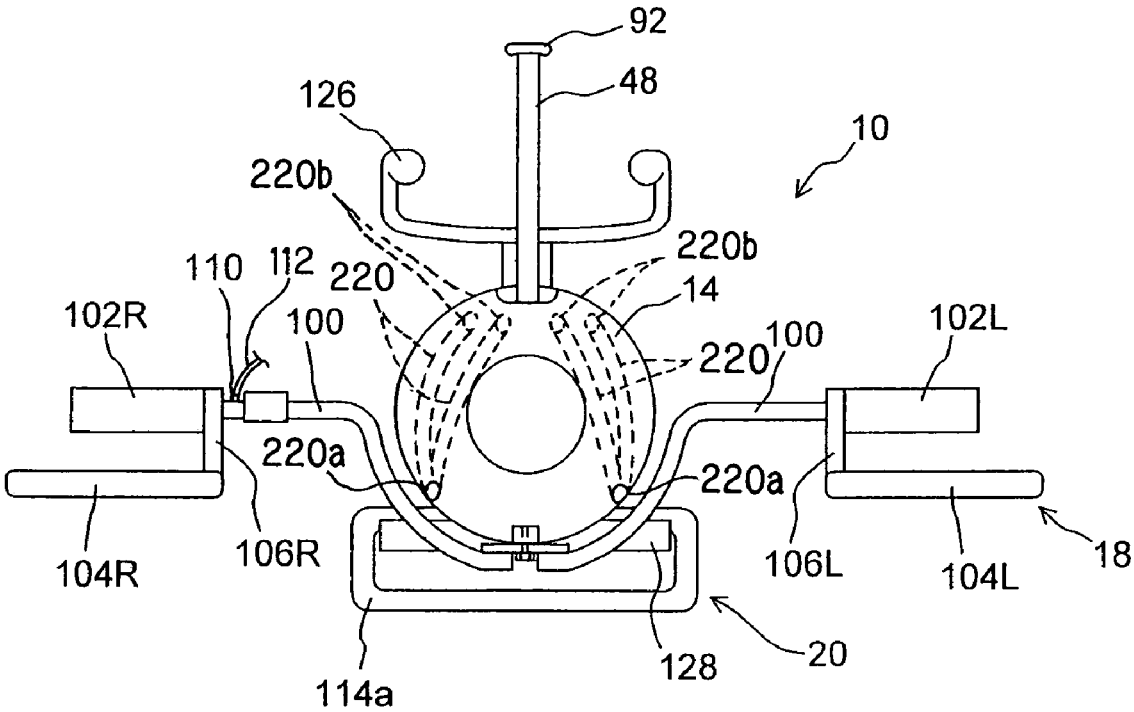
FIG. 30 is a front view of the underwater scooter shown in FIG. 28.

FIG. 28 is a top view of an underwater scooter according to the sixth embodiment. In addition, FIG. 29 is a left side view of the underwater scooter shown in FIG. 28. FIG. 30 is a front view of the underwater scooter shown in FIG. 28.

Figure 31:
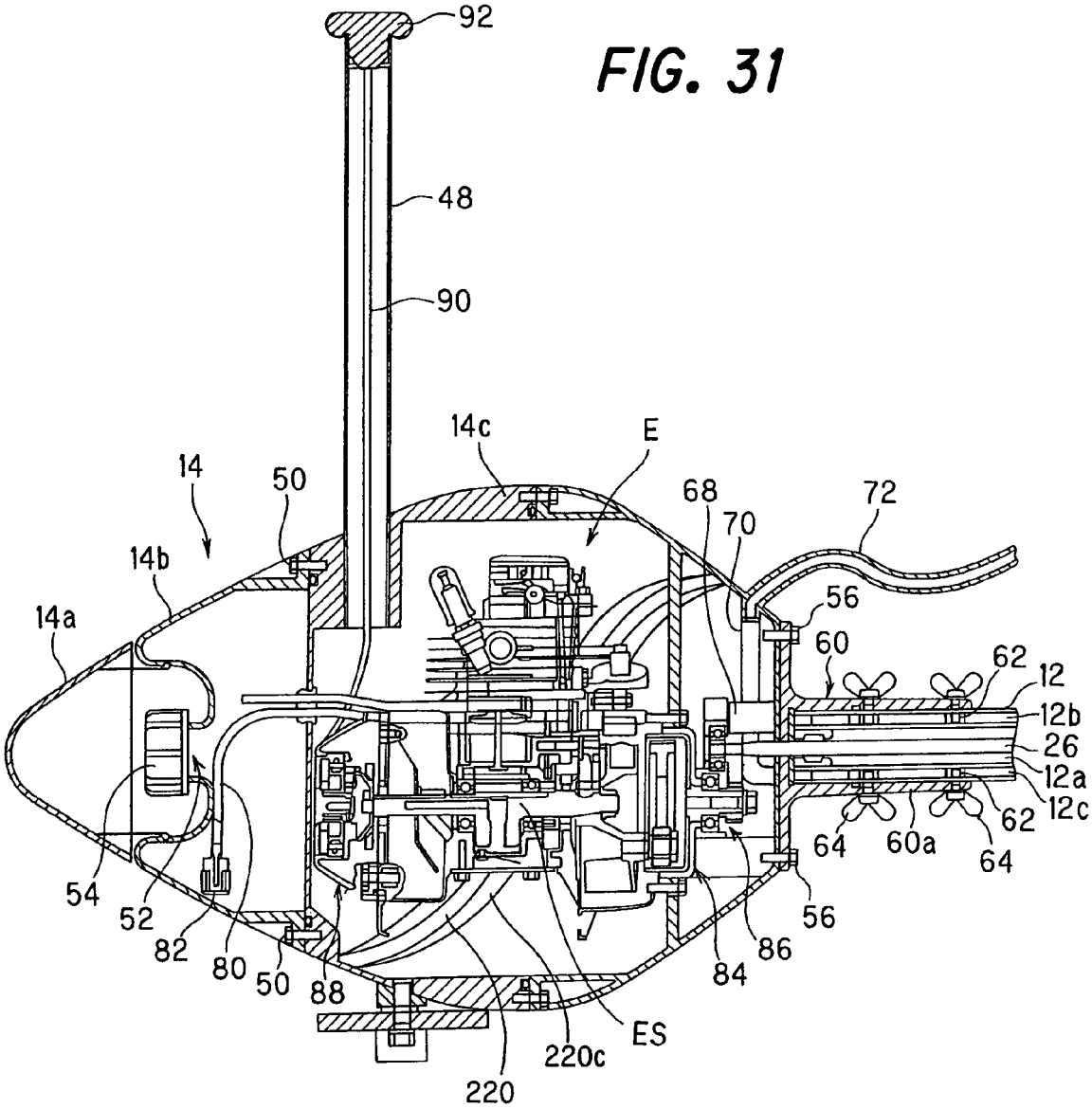
FIG. 31 is an enlarged cross section along the line XXXI—XXXI in FIG. 28.
Figure 32:
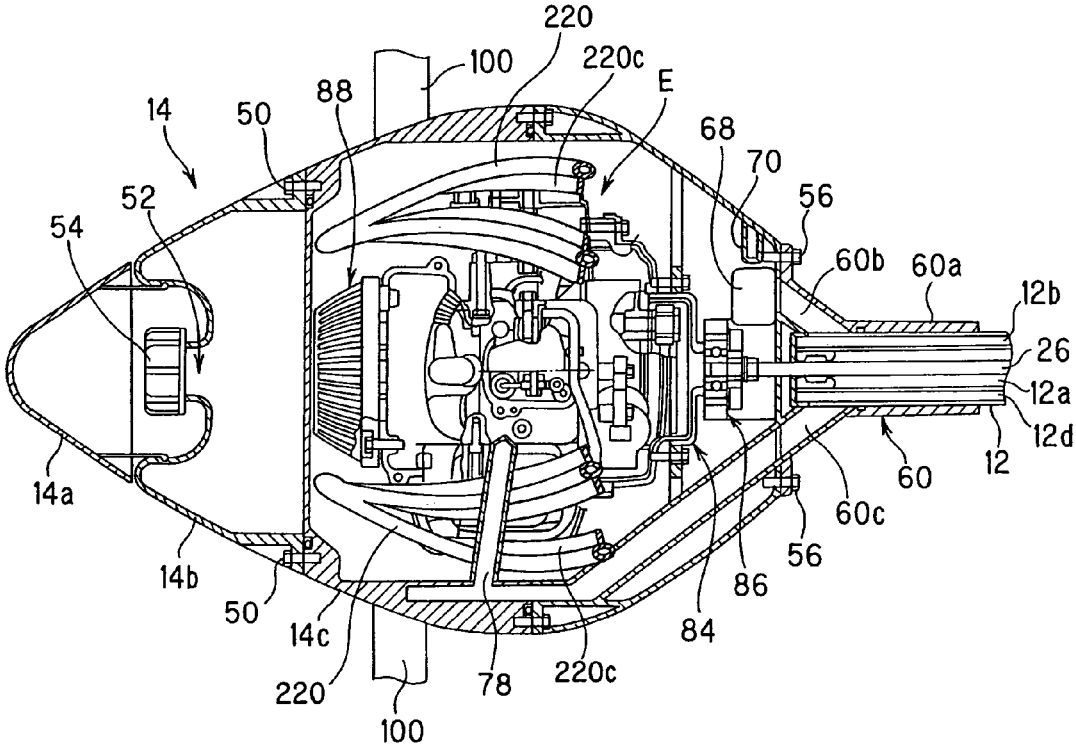
FIG. 32 is an enlarged cross section along the line XXXII—XXXII in FIG. 29.

FIG. 31 is an enlarged cross section along the line XXXI—XXXI in FIG. 28. FIG. 32 is an enlarged cross section along the line XXXII—XXXII in FIG. 29.

As shown in FIG. 31 and FIG. 32, a water path 220 is provided in the interior of the engine enclosure 14*c*. As indicated by the broken lines in FIGS. 28–30, the water path 220 is formed from a plurality of paths, specifically four.

Figure 33:
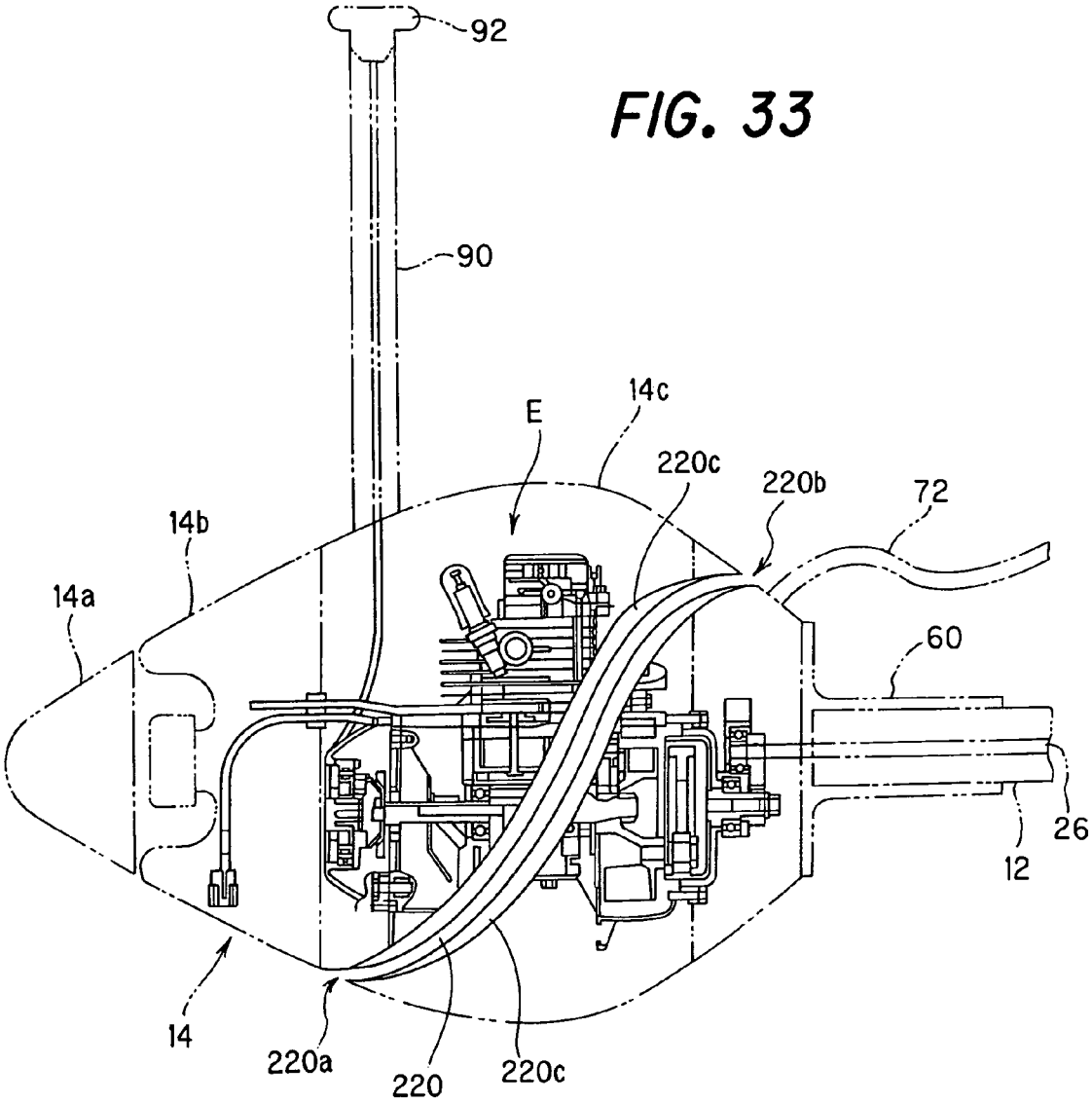
FIG. 33 is a side view of a water path shown in FIG. 28.
Figure 34:
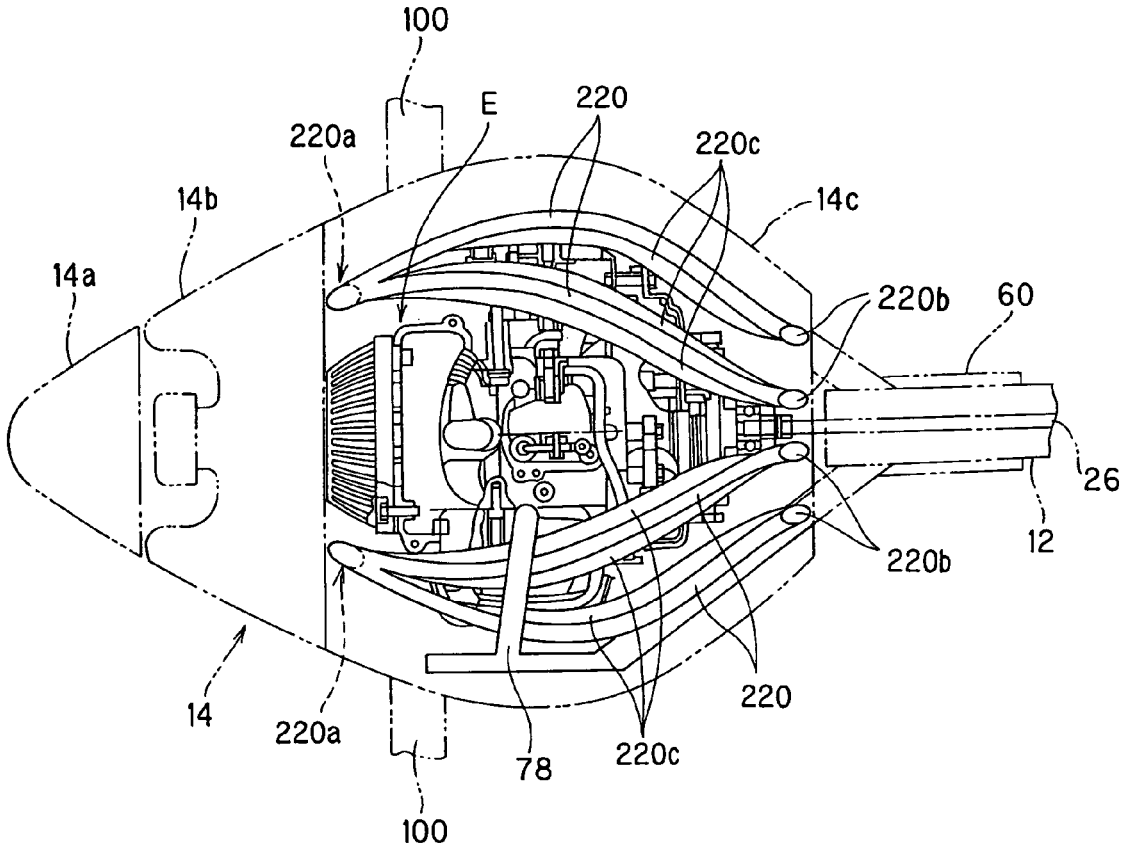
FIG. 34 is a top view of the water path of FIG. 33.

FIG. 33 is a side view of the water path 220, while FIG. 34 is a top view of the water path 220.

As shown in FIG. 33 and FIG. 34, a plurality of water inlets 220*a*, specifically two, is formed in the fore part of the bottom surface of the watertight vessel 14 such that they are open toward the fore in the direction of forward motion. In addition, a plurality of water outlets 220*b*, specifically four, is formed in the aft part of the top surface of the watertight vessel 14 such that they are open toward the aft in the direction of forward motion.

The water path 220 passes near the engine E or its exhaust pipe 78 and also is formed so that it allows the water inlets 220*a* and water outlets 220*b* to communicate. Specifically, the water path 220 comprises two sets of pipelines from the water inlets 220*a* to the water outlets 220*b* that branch into two in between, and thus the two water inlets 220*a* communicate with the four water outlets 220*b*.

In addition, fins 220*c* (heat absorption means) are provided around each part of the water path 220. As shown in the figures, a plurality of fins 220*c* is formed around each part of the water path 220 and also each of the fins 220*c* is formed continuously from near the water inlets 220*a* to near the water outlets 220*b*.

As the underwater scooter 10 travels (moves forward), water (a fluid) flows into the water path 220 from the water inlets 220*a* that are open toward the fore in the direction of forward motion. The water flowing into the water path 220 undergoes heat exchange there with the air within the watertight vessel 14 (air that is heated by the heat of the engine E), is heated and is then discharged from the water outlets 220*b* that are open toward the aft in the direction of forward motion to the aft of the underwater scooter 10. Note that providing fins 220*c* on the water path 220 (thus increasing the surface area of contact with the air within the watertight vessel 14) promotes heat exchange between the water flowing through the water path 220 and the air within the watertight vessel 14, and thus the air within the watertight vessel 14 is even more effectively cooled (and the water (warm water) discharged from the water outlets 220*b* is even more effectively warmed).

Figure 35:
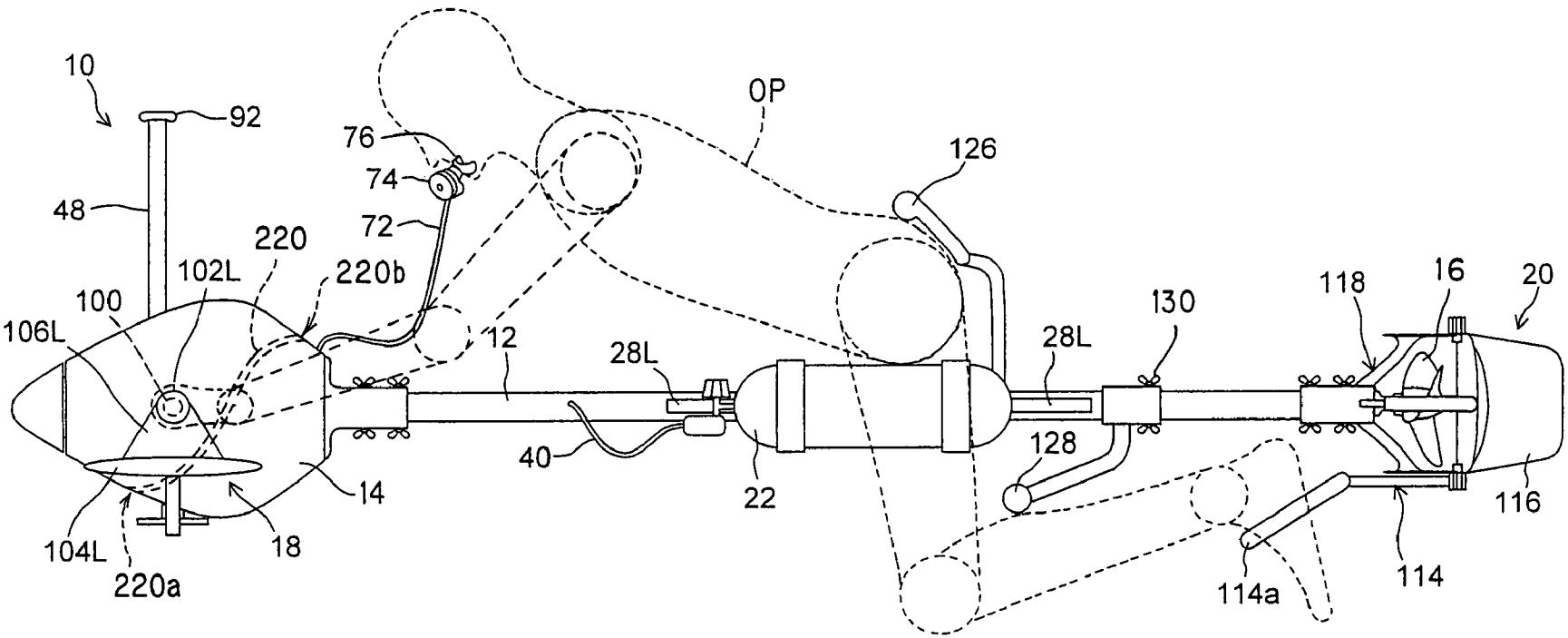
FIG. 35 is a left-side view of the underwater scooter, with the operator riding thereon, shown in FIG. 29.

FIG. 35 is a left-side view of the underwater scooter 10 and an operator riding it.

As described above, as the underwater scooter 10 travels, water flows into the water path 220 from the water inlets 220*a* that are open toward the fore in the direction of forward motion. The water flowing into the water path 220 undergoes heat exchange there with the air within the watertight vessel 14, is heated and is then discharged from the water outlets 220*b* that are open toward the aft in the direction of forward motion to the aft of the underwater scooter 10, or specifically toward the operator OP. Specifically, the water flowing into the water path 220 is used as coolant that cools the interior of the watertight vessel 14 (specifically, the engine E enclosed therein) and then is supplied to the operator OP as warm water to warm the body.

In this manner, with the underwater scooter 10 according to the sixth embodiment, the watertight vessel 14 disposed aft of the operator OP, the engine E enclosed in the watertight vessel 14, the water inlets 220*a* in the watertight vessel 14 that are open toward the fore, the water outlets 220*b* in the watertight vessel 14 that are open toward the aft and the water path 220 that passes near the engine E and allows the water inlets 220*a* and water outlets 220*b* to communicate are provided, so water flowing into the water path 220 undergoes heat exchange with the air within the watertight vessel 14, and thus the radiation of heat by the engine E is improved and overheating can be prevented. In addition, the water warmed by the heat exchange (warm water) is discharged from the water outlets 220*b* toward the operator, so the body of the operator can be warmed to improve comfort.

In addition, the fins 220*c* are provided on the water path 220 to promote heat exchange between the fluid flowing through the water path 220 and the air within the watertight vessel 14, so the radiation of heat by the engine E can be improved and also the water (warm water) discharged toward the operator is even more effectively warmed. Thus, even with a simple constitution, overheating of the engine E can be even more effectively prevented and the operator can be kept warm more effectively, further increasing comfort.

In addition, the propeller 16 is disposed toward the aft of the main frame 12 upon which the operator rides, so the jet of water ejected by the propeller does not chill the body of the operator.

Note that in the above, the engine E is given as an example of the drive power that drives the propeller 16, but the invention is also applicable to other types of drive power as long as they generate heat while operating.

In addition, a water pump may be provided en route within the water path 220 to create a forced flow of water within the water path 220. Moreover, the engine E may be provided with a water jacket (of coolant passages) and the inlets and outlets of the water jacket may be connected to the water path 220 so that the water pump supplies fluid (coolant) to the water jacket. In addition, a fan may be provided on the crankshaft ES of the engine E to circulate the air within the watertight vessel 14.

The first to sixth embodiments are thus configured to have an underwater scooter 10 on which an operator OP is seated to operate to travel on a surface of water or underwater, comprising: a main frame 12 disposed such that its lengthwise direction is parallel to a direction of forward motion of the scooter; a watertight vessel 14 disposed on the main frame toward a fore end thereof in the direction of forward motion; a drive power unit (internal combustion engine E) enclosed within an interior of the watertight vessel; a propeller 16 disposed on the main frame; a driveshaft 26 passing through an interior of the main frame and transmitting an output of the drive power to the propeller so as to turn it; and a saddle portion (first and second air tank 22, 24), disposed upon the main frame between the watertight vessel and propeller, on which the operator saddles.

The underwater scooter further includes: a depth adjusting mechanism 18 enabling the scooter to dive or surface, comprising: a grip 102L, 102R provided to be gripped and to be operated by the operator; and an elevator 104L, 104R connected to the grip.

The underwater scooter further includes: a steering mechanism 20 enabling the scooter to be steered and the steering mechanism comprising: a foot stand 114 provided to be operated by a foot of the operator; and a rudder 116 connected to the foot stand.

The underwater scooter further includes: a waist holder 126 holding waist of the operator.

In the underwater scooter, the saddle portion is attached to the main frame 12 such that it can slide freely in the direction of forward motion.

The underwater scooter further includes: a leg rest 128 attached to the main frame 12 and supporting a foot of the operator.

In the underwater scooter, the propeller 16 is disposed on the main frame 12 toward the aft end thereof in the direction of forward motion, and further including: a second or auxiliary main frame (a two-behind main frame 12B) having a shorter length than the main frame 12 in the direction of forward motion and interchangeable with the main frame; a second or auxiliary drive shaft (a tow-behind driveshaft 26B) having a shorter length than the driveshaft 26 in the direction of forward motion and interchangeable with the driveshaft 26; and a steering mechanism 20 attachable to at least one of the main frame and the second main frame for enabling the scooter to be steered.

In the underwater scooter, the steering mechanism 20 is operated by a foot of the operator when attached to the main frame 12, and is operated by a hand of the operator when attached to the second main frame 12B.

In the underwater scooter, at least, one of the watertight vessel 14 and the steering mechanism 20 is removably attached to the main frame 12 and the second main frame 12B.

In the underwater scooter, the drive power unit is an internal combustion engine and further including: a snorkel 48 allowing the interior of the watertight vessel to communicate with atmosphere; and a first air tank 22 containing air to be supplied to the interior of the watertight vessel, such that air to be used for combustion in the engine is supplied from at least one of the snorkel and the first air tank.

The underwater scooter further includes: a first air-destination changer (switchover valve 180) changing destination to which air contained in the first air tank 22 is supplied, to the operator.

In the underwater scooter, the first air tank 22 is attached to the main frame 12 such that it can slide freely in the direction of forward motion.

The underwater scooter further includes: a first remaining air indicator (pressure gage 170*a*) detecting and indicating an amount of air remaining in the first air tank.

The underwater scooter further includes: a recoil starter 88 used to start the engine and having a grip 92 that can seal an opening of the snorkel 48.

The underwater scooter further includes: a one-way check valve (third one-way check valve 280) opening to allow the watertight vessel 14 to communicate with outside when an internal pressure of the watertight vessel exceeds a stipulated pressure.

The underwater scooter further includes: a second air tank 24 containing air to be supplied to the operator.

The underwater scooter further includes: a second air-destination changer (switchover valve 180*b*) changing destination to which air contained in the second air tank 24 is supplied, to the watertight vessel.

In the underwater scooter, the second air tank 24 is attached to the main frame 12 such that it can slide freely in the direction of forward motion.

The underwater scooter further includes: a second remaining air indicator (pressure gage 170*b*) detecting and indicating an amount of air remaining in the second air tank 24.

In the underwater scooter, the saddle area comprises the first air tank 22 and the second air tank 24.

In the underwater scooter, the drive power unit is an internal combustion engine E and an interior of the main frame 12 is provided with at least two passages from among five passages including: a first passage 12a serving as a path through which the driveshaft passes; a second passage 12b serving as a path through which air to be used in combustion of the engine passes; a third passage 12c serving as a path through which air to be used for breathing of the operator passes; a fourth passage 12d serving as a path through which exhaust gas from the engine passes; and a fifth passage 12e serving as a path through which the watertight vessel is communicated with outside.

The underwater scooter further includes: a first one-way check valve 94 disposed at the fourth passage and opening to allow the fourth passage to communicate with outside when an internal pressure of the fourth passage exceeds a stipulated pressure and a second one-way check valve 96 disposed at the fifth passage and opening to allow the fifth passage to communicate with outside when an internal pressure of the fifth passage exceeds a stipulated pressure.

The underwater scooter further includes: a water inlet (220*a*) formed in the watertight vessel 14 such that it is opened toward the fore in the direction of forward motion; a water outlet (220*b*) formed in the watertight vessel such that it is opened toward the aft in the direction of forward motion; and a water path (220) passing near the drive power and communicating the water inlet and the water outlet.

In the underwater scooter, the water path has a heat absorber (fins 220*c* or heat absorption means) promoting heat exchange between air in the watertight vessel and fluid in the water path, specifically the heat absorber comprises fins 220*c* provided around the water path.

Japanese Patent Application Nos. 2004-116150, 2004-116151, 2004-116152, 2004-116153, 2004-116154 and 2004-116160, all filed on Apr. 9, 2004, are incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. An underwater scooter operable to enable a user to travel thereon on a surface of water or underwater, said scooter comprising:

a main frame disposed such that a lengthwise direction thereof extends parallel to a direction of forward motion of the scooter;

a watertight vessel disposed on the main frame toward a fore end thereof in the direction of forward motion;

a drive power unit enclosed within an interior of the watertight vessel;

a propeller disposed on the main frame;

a driveshaft passing through an interior of the main frame and transmitting an output of the drive power unit to the propeller so as to turn it; and a saddle portion, disposed upon the main frame between the watertight vessel and propeller, on which the operator saddles.

2. The underwater scooter according to claim 1, further including:

a depth adjusting mechanism enabling the scooter to dive or surface, comprising:

a grip provided to be gripped and to be operated by the operator; and an elevator connected to the grip.

3. The underwater scooter according to claim 1, further including:

a steering mechanism enabling the scooter to be steered and the steering mechanism comprising:

a foot stand provided to be operated by a foot of the operator; and a rudder connected to the foot stand.

4. The underwater scooter according to claim 1, further including:

a waist holder which holds the operator's waist.

5. The underwater scooter according to claim 1, wherein the saddle portion is attached to the main frame such that it can slide freely in the direction of forward motion.

6. The underwater scooter according to claim 1, further including: a leg rest attached to the main frame and which supports a foot of the operator.

7. The underwater scooter according to claim 1, wherein the propeller is disposed on the main frame toward an aft end thereof in the direction of forward motion, and the scooter further includes:

an auxiliary main frame having a shorter length than the main frame in the direction of forward motion and interchangeable with the main frame;

an auxiliary driveshaft having a shorter length than the driveshaft in the direction of forward motion and interchangeable with the driveshaft; and a steering mechanism attachable to at least one of the main frame and the auxiliary main frame for enabling the scooter to be steered.

8. The underwater scooter according to claim 7, wherein the steering mechanism is operated by a foot of the operator when attached to the main frame, and is operated by a hand of the operator when attached to the auxiliary main frame.

9. The underwater scooter according to claim 7, wherein at least one of the watertight vessel and the steering mechanism is removably attached to the main frame and the auxiliary main frame.

10. The underwater scooter according to claim 1, wherein the drive power unit is an internal combustion engine, and the scooter further includes:

a snorkel allowing the interior of the watertight vessel to communicate with atmosphere; and a first air tank containing air to be supplied to the interior of the watertight vessel, such that air to be used for combustion in the engine is supplied from at least one of the snorkel and the first air tank.

11. The underwater scooter according to claim 10, further including:

a first air-destination changer which changes a destination to which air contained in the first air tank is supplied, to the operator.

12. The underwater scooter according to claim 10, wherein the first air tank is attached to the main frame such that it can slide freely in the direction of forward motion.

13. The underwater scooter according to claim 10, further including:

a first remaining air indicator detecting and indicating an amount of air remaining in the first air tank.

14. The underwater scooter according to claim 10, further including:

a recoil starter that enables the engine to be started and has a grip that seals an opening of the snorkel.

15. The underwater scooter according to claim 14, further including:

a one-way check valve which opens to allow the watertight vessel to communicate with outside when an internal pressure of the watertight vessel exceeds a stipulated pressure.

16. The underwater scooter according to claim 10, further including:

a second air tank containing air to be supplied to the operator.

17. The underwater scooter according to claim 16, further including:

a second air-destination changer which changes a destination to which air contained in the second air tank is supplied, to the watertight vessel.

18. The underwater scooter according to claim 16, wherein the second air tank is attached to the main frame such that it can slide freely in the direction of forward motion.

19. The underwater scooter according to claim 16, further including:

a second remaining air indicator detecting and indicating an amount of air remaining in the second air tank.

20. The underwater scooter according to claim 16, wherein the saddle portion comprises the first air tank and the second air tank.

21. The underwater scooter according to claim 1, wherein the drive power unit is an internal combustion engine and an interior of the main frame is provided with at least two passages from among five passages including:

a first passage serving as a path through which the driveshaft passes;

a second passage serving as a path through which air to be used in combustion of the engine passes;

a third passage serving as a path through which air to be used for breathing of the operator passes;

a fourth passage serving as a path through which exhaust gas from the engine passes; and a fifth passage serving as a path through which the watertight vessel is communicated with outside.

22. The underwater scooter according to claim 21, further including:

a one-way check valve disposed at the fourth passage and opening to allow the fourth passage to communicate with outside when an internal pressure of the fourth passage exceeds a stipulated pressure.

23. The underwater scooter according to claim 21, further including:

a one-way check valve disposed at the fifth passage and opening to allow the fifth passage to communicate with outside when an internal pressure of the fifth passage exceeds a stipulated pressure.

24. The underwater scooter according to claim 1, further including:

a water inlet formed in the watertight vessel such that it opens toward the fore end of the vessel in the direction of forward motion;

a water outlet formed in the watertight vessel such that it is opened toward the aft end of the vessel in the direction of forward motion; and a water path passing near the drive power unit and communicating the water inlet and the water outlet.

25. The underwater scooter according to claim 24, wherein the water path has a heat absorber promoting heat exchange between air in the watertight vessel and fluid in the water path.

26. The underwater scooter according to claim 25, wherein the heat absorber comprises fins provided around the water path.

* * * * *